US009150295B2

(12) United States Patent
West et al.

(10) Patent No.: US 9,150,295 B2
(45) Date of Patent: Oct. 6, 2015

(54) MODULAR PERSONAL WATERCRAFT

(71) Applicant: Bomboard LLC, Whitewater, WI (US)

(72) Inventors: John H. West, Whitewater, WI (US); Anders Stubkjaer, Rolling Meadows, IL (US)

(73) Assignee: Bomboard LLC, Whitewater, WI (US)

( * ) Notice: Subject to any disclaimer, the term of this patent is extended or adjusted under 35 U.S.C. 154(b) by 0 days.

(21) Appl. No.: 14/363,107

(22) PCT Filed: Apr. 25, 2013

(86) PCT No.: PCT/US2013/038244
§ 371 (c)(1),
(2) Date: Jun. 5, 2014

(87) PCT Pub. No.: WO2013/163445
PCT Pub. Date: Oct. 31, 2013

(65) Prior Publication Data

US 2015/0050847 A1 Feb. 19, 2015

Related U.S. Application Data

(60) Provisional application No. 61/638,181, filed on Apr. 25, 2012.

(51) Int. Cl.

| | |
|---|---|
| ***B63H 11/04*** | (2006.01) |
| ***B63B 43/14*** | (2006.01) |
| ***B63B 7/04*** | (2006.01) |
| ***B63B 35/73*** | (2006.01) |
| ***B63B 7/08*** | (2006.01) |
| ***B63B 35/71*** | (2006.01) |
| ***B63H 11/113*** | (2006.01) |
| ***B63H 21/32*** | (2006.01) |

(52) U.S. Cl.
CPC *B63H 11/04* (2013.01); *B63B 7/04* (2013.01); *B63B 7/08* (2013.01); *B63B 35/71* (2013.01); *B63B 35/731* (2013.01); *B63B 43/14* (2013.01); *B63H 11/113* (2013.01); *B63H 21/32* (2013.01)

(58) Field of Classification Search
CPC ..... B63H 11/04; B63H 21/32; B63B 43/14
USPC ..... 441/56, 58; 114/144 R; 440/40, 42
See application file for complete search history.

(56) References Cited

U.S. PATENT DOCUMENTS

| | | | | | |
|---|---|---|---|---|---|
| 4,698,034 | A | * | 10/1987 | Anthonijsz | 440/27 |
| 4,875,426 | A | * | 10/1989 | Soga et al. | 114/123 |
| 5,349,918 | A | * | 9/1994 | Elie | 114/352 |

(Continued)

OTHER PUBLICATIONS

Search Report and the Written Opinion of the International Searching Authoritty dated Aug. 19, 2013—(14) pages.

*Primary Examiner* — S. Joseph Morano
*Assistant Examiner* — Jovon Hayes
(74) *Attorney, Agent, or Firm* — Boyle Fredrickson, S.C.

(57) ABSTRACT

Personal watercraft and watercraft power systems that include a power pod for supporting a power plant and a propulsion unit. An engine or an electric motor and a pump assembly are enclosed in the power pod. One or more sponsons removably cooperate with the power pod via a mechanical interface, such as dovetail joints and/or interlocking channels, formed between the power pod and the respective sponsons. A plurality of tool-lessly operable mechanical interfaces, locking mechanism(s), and fluid or electrical signal connectors allow the sponson(s) to be selectively secured to the power pod such that the resultant watercraft is modular and transportable by a single person when necessary.

29 Claims, 29 Drawing Sheets

(56) References Cited

U.S. PATENT DOCUMENTS

| | | | | |
|---|---|---|---|---|
| 5,660,132 | A * | 8/1997 | Pasley | 114/144 R |
| 6,276,291 | B1 * | 8/2001 | Lapointe et al. | 114/144 R |
| 8,393,287 | B2 * | 3/2013 | Spade et al. | 114/284 |
| 8,485,115 | B2 * | 7/2013 | Spade et al. | 114/55.54 |
| 2007/0281561 | A1 * | 12/2007 | West et al. | 440/42 |
| 2011/0217891 | A1 * | 9/2011 | Cray | 441/130 |
| 2011/0265705 | A1 * | 11/2011 | Spade et al. | 114/65 R |
| 2015/0050847 | A1 * | 2/2015 | West et al. | 440/40 |

* cited by examiner

MODULAR PERSONAL WATERCRAFT

CROSS-REFERENCE TO RELATED APPLICATION

This patent application claims priority to U.S. Provisional Patent Application Ser. No. 61/638,181 filed on Apr. 25, 2012 titled "Modular Personal Watercraft" and the contents of which are incorporated herein.

BACKGROUND OF THE INVENTION

1. Field of the Invention

The present invention relates generally to the field of watercrafts and more particularly to jet-powered personal watercraft (PWC). Specifically, a preferred embodiment of the present invention relates to jet-powered personal watercraft constructed of a modular design. The present invention is particularly applicable to a personal watercraft of the type that allows the user or operator to easily assemble and disassemble the watercraft into multiple parts for ease of transportation.

2. Discussion of the Related Art

Historically, it was known in the prior art to provide a jet-powered personal watercraft of the type generally here under consideration. A conventional personal watercraft is typically understood as a watercraft constructed to support an operator and possibly as many as two passengers on water. Typically, such personal watercraft is transported via a trailer that is towed by a vehicle to a water environment such as a lake, river, or ocean. For example, an individual who does not own property with water access must provide his own transportation for a personal watercraft to the water. The added expense of owning a trailer and an automobile capable of hauling a traditional personal watercraft prevents many people from enjoying the sport of personal watercraft operation. Further, the operator of the personal watercraft may also live in an urban area where there are limited facilities for launching the personal watercraft with the use of a trailer and there also may be limited space for storing a trailer and personal watercraft when not in use.

Another drawback of conventional personal watercraft is the relative weight thereof. A majority of such watercraft is constructed of a single piece and is too heavy for a single person to lift or move. Additionally, most personal watercraft must be constructed of sufficient size to provide a buoyant force equal to the weight of the personal watercraft, as well as the weight of the operator and/or passengers. Accordingly, such conventional personal watercrafts are relatively large and bulky. The size of such devices complicates non-operating transportation and storage of the watercraft.

Another drawback of known personal watercraft systems is the relatively monolithic construction of such devices. Such devices commonly include a plurality of components, including an engine disposed within a one-piece waterproof hull. Frequently removing components from within the hull is a time-consuming and laborious process. Furthermore, servicing of the components of the personal watercraft requires either removal of the component directly therefrom or transportation of the entirety of the personal watercraft to a service destination. Such transportation is commonly facilitated via a trailer, which is configured to directly support the personal watercraft. That is, such watercraft is substantially non-shippable aside from commercial shipping services. The relatively unitary construction of such assemblies prevents convenient and economical transportation of the personal watercraft for servicing and the like. Such devices are commonly locally serviced due, in part, to the inconvenient transportation of the device or components thereof.

Therefore, it would be desirable to design a personal watercraft constructed of a modular design wherein the respective modules are conveniently separable and easily transportable. To facilitate assembly and disassembly by an operator, it is also desirable that each module attaches and detaches in a tool-less manner. Further desirable is to provide a watercraft power system that is removable, compact, and lightweight to allow separate transport of the watercraft and power system. Lastly, manufacturing methods that lower production costs are also desirable.

U.S. Pat. No. 6,918,804 discloses a personal watercraft. One disadvantage to such designs is that consumable fluids and engine operation systems such as fuel, oil, a battery, etc. are contained in a generally singular engine compartment defined by the unitary hull which adds undue weight when an operator wishes to transport the watercraft. As these materials are all hazardous, it is therefore desirable to place the fluids and battery in separate, detachable compartments allowing the user to transport the disassembled watercraft with greater ease.

U.S. Pat. No. 4,932,347 discloses another personal watercraft having a hull that is constructed of a monolithic design. Transportation of the watercraft necessitates a trailer and a vehicle capable of pulling the load of the watercraft and trailer. Furthermore, should any part of the watercraft necessitate service or repair, the entire watercraft must commonly be transported to a repair or service facility with a trailer, as the watercraft is too large to cost-effectively ship with conventional residential shipping methods and/or companies. It is therefore desirable to provide a personal watercraft that can be conveniently at least partly disassembled into individual components to facilitate shipment of only desired or damaged portions of the watercraft for servicing of the same.

SUMMARY AND OBJECTS OF THE INVENTION

By way of summary, the present invention is directed to a modular, personal watercraft that overcomes the aforementioned drawbacks. An effect of the modular, personal watercraft is to allow a user to disassemble the watercraft without the use of special tools into parts light and small enough for a single person to carry or transport with limited effort. The modular, personal watercraft includes a power pod for supporting a water jet pump and power plant or engine system. The power pod is molded to support the power and propulsion system and to removably engage a watercraft or one or more sponsons shaped to define the resultant shape of the watercraft. In a preferred embodiment, an internal combustion engine and an axial flow jet pump are enclosed in the power pod. It is appreciated that the power plant may alternatively be provided as an electric motor and that the jet pump may have configuration other than an axial flow jet pump provided the pump output is suitable for providing suitable propulsion for the resultant watercraft. The power pod is constructed to removably engage one or more sponsons or supplemental floatable hull portions or floats via a slidable mechanical interface, such as interlocking channels and/or dovetail joints, and tool-lessly operable locking mechanisms, such as spring-loaded quick connectors such that the power pod and the one or more sponsons are conveniently connectable allowing assembly and disassembly in nearly any location without the use of tools. The power pod and each sponson are also preferably individually buoyant, allowing the watercraft to stay afloat should one of the sponsons lose buoyancy.

Therefore, according to one aspect, a modular personal watercraft is disclosed that includes a power pod encapsulating a power plant and a steering mechanism associated with operation of the personal watercraft. The power pod includes at least one interface that is defined by at least one projection and at least one recess. A cover removably cooperates with the power pod to allow access to an engine compartment defined by the power pod. The cover is configured to cooperate with the power pod so that the power pod is generally sealed and buoyant when the cover is engaged therewith. Understandably, the power pod could be watertight or configured to allow passage of a gas associated with a combustion process therethrough depending on the mode of operation associated with the power plant disposed in the power pod. At least one sponson removably cooperates with the power pod and is preferably entirely or at least generally watertight and buoyant. The at least one sponson includes an engagement structure that is defined by at least one projection and at least one recess such that the engagement structure of the at least one sponson and the at least one interface of the power pod are translatable relative to one another to index a position of the at least one sponson relative to the power pod and generate a physical interference between the at least one sponson and the power pod.

Another aspect discloses a power pod for a personal watercraft wherein the power pod includes a hull that defines an interior facing surface and an exterior facing surface. A power plant is disposed in a volume generally surrounded by the hull such that the interior facing surface of the hull faces the power plant. At least a portion of the exterior facing surface of the hull defines an interface that is constructed to removably cooperate with a hull portion such that the hull of the power pod and supplemental hull portion cooperate to define a shape of a resultant watercraft hull.

Another aspect discloses a method of forming a watercraft power pod that includes forming a first hull portion to contain a power plant, forming a second hull portion that removably cooperates with the first hull portion, and shaping the first hull portion and the second hull portion to form a mechanical interface that limits motion between the first hull portion and the second hull portion in at least two directions when the first hull portion and the second hull portion are positionally associated with one another.

Preferably, one or more wheels movably or removably cooperate with hull of the power pod to facilitate partially ground supported transport of the power pod. The power pod is configured to cooperate with a power plant such as an engine or a motor. One or more of the sponsons are configured to contain the consumables, such as fuel and/or oil, and/or batteries, associated with operation of the power plant and/or marine accessories such a fire suppression device, supplemental floatation devices, personal devices, or other marine type accessories such as whistle, a flare, a mirror, tow rope, etc. Preferably, a tool-less and selectively severable connection is provided in the conductors or fluid connection tubes associated with communicating the battery signal or consumable materials between the power plant and the sponson associated with containing the same. Another preferred aspect includes providing an adjustable or multi-positionable steering assembly that facilities different orientations of an operator during use of the watercraft and provides a compact footprint of the steering assembly when the watercraft is not in use.

The modular design of the personal watercraft also allows newer construction techniques to be employed in the formation of the watercraft. Some types of manufacturing that may be utilized include blow molding, injection molding, and rotomolding. Molding each part of the personal watercraft offers a low-cost manufacturing solution. Should a section of the watercraft become damaged, instead of replacing the entire hull, as is typically done, the damaged section may be removed, and a new section may be shipped to the customer. This ensures limited downtime and low repair costs to both the user and the manufacturer.

These and other aspects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
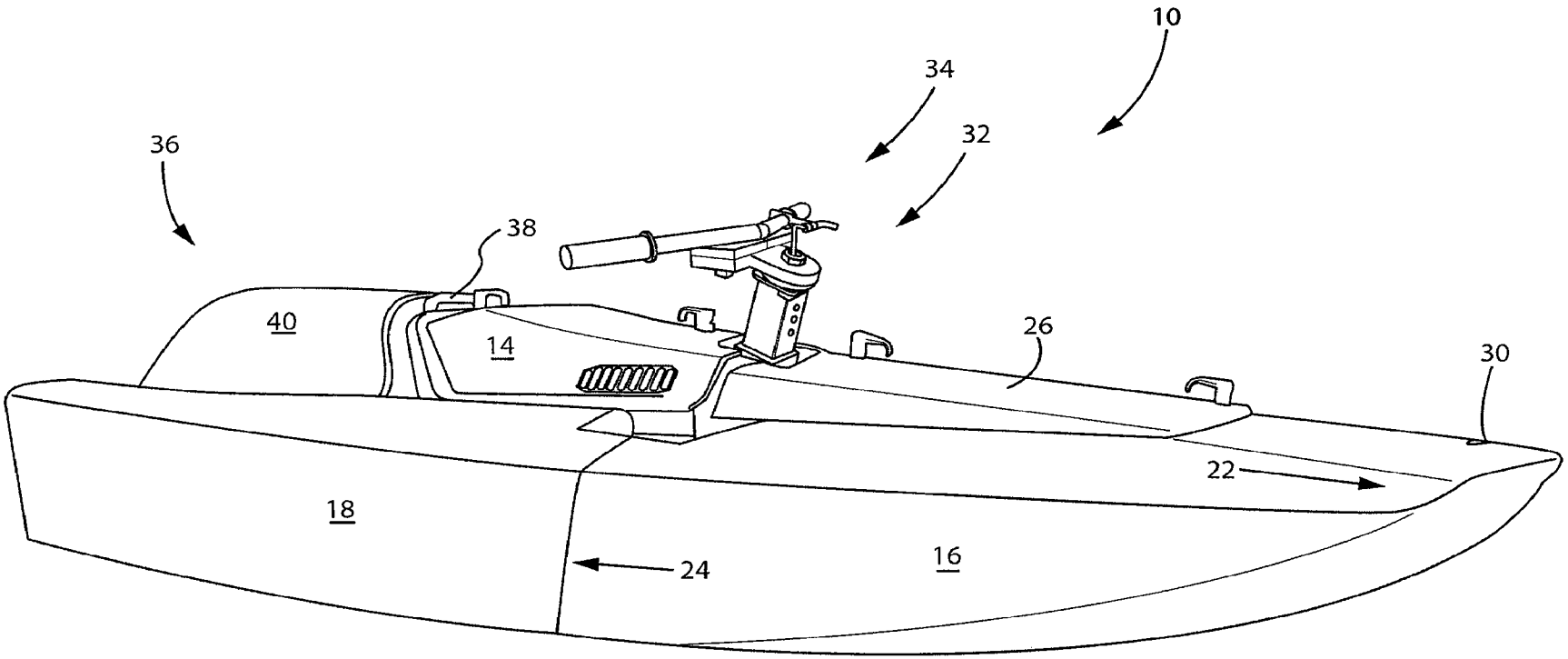
FIG. 1 is a front side perspective view of a personal watercraft or simply watercraft according to the present invention.

In describing the preferred embodiment of the invention, which is illustrated in the drawings, specific terminology will be referred to for the sake of clarity. However, it is not intended that the invention be limited to the specific terms so selected and it is to be understood that each specific term includes all technical equivalents which operate in a similar manner to accomplish a similar purpose. For example, the words "connected", "attached", or terms similar thereto are often used. They are not limited to direct connection but include connection through other elements where such connection is recognized as being equivalent by those skilled in the art.

DESCRIPTION OF PREFERRED EMBODIMENTS

The present invention and the various features and advantageous details thereof are explained more fully with reference to the non-limiting embodiments described in detail in the following description.

1. System Overview

The above-mentioned requirements of transportability and disassembly without special tools are impossible in the case of conventional personal watercraft. However, it is rendered possible to satisfy these requirements to various extents by employing a separable power pod and one or more sponsons or floats thereby allowing an operator to transport and load or unload discrete portions of a watercraft into or from a vehicle, thus eliminating the need for a trailer for transporting the watercraft. Although described hereinafter as being directed to personal watercraft systems, or a watercraft configured to support an operator and/or possibly one or two riders in a generally aligned or orientation, it is appreciated that features of the present invention, such as a separable power pod as described hereinafter, may be useable for powering watercraft having other shapes and configurations, such as a boat, a rigid inflatable boat, a canoe, a kayak, a catamaran, etc. The personal watercraft system preferably includes a power pod for supporting a power plant and a water jet system associated with propulsion of the watercraft. It is further appreciated that the power plant may be a gasoline engine or an electric motor. Regardless of the operating modality of the power plant, the power pod is shaped to removably cooperate with one or more sponsons, floats, or supplemental hull portions associated with defining at least a portion of the shape of the resultant watercraft. In a preferred embodiment as described below, the watercraft includes a pair of aft sponsons that are removably attachable to alternate lateral sides of the power pod and a forward oriented sponson such that the plurality of sponsons cooperate with the power pod to define a personal watercraft.

A steering mechanism is connected to the personal watercraft system for allowing an operator to control the speed and direction of travel of the personal watercraft. The steering mechanism is located in a forward portion of the power pod for limiting inadvertent operator contact therewith and such that the operator can be primarily positioned above the power pod during operation of the watercraft. The orientation and construction of the steering system improves operator comfort and enhances operator enjoyment from operation of personal watercraft.

The power pod internally houses a water jet pump and engine or motor system. The power pod is constructed to support the power system and removably engage one or more of a plurality of sponsons. An engine or motor and a pump are enclosed in the power pod and are operatively connected by a drive system such that operation of the power plant effectuates operation of the pump. Supplemental systems associated with operation of the power plant, such as a fuel and/or oil source when the power plant is an engine, or a battery system when the power plant is provided as a motor and/or the engine is equipped with a power starting system, are disposed in one or more of the sponsons such that the fuel source and/or oil source and/or batteries are remotely located relative to the power pod. Such segregation reduces the weight associated with any one of the power pod and/or the respective sponsons thereby providing a personal watercraft system that is easily transportable, highly versatile, and dynamic.

Therefore, one embodiment includes a modular personal watercraft having a power pod encapsulating a power plant and a steering mechanism of the personal watercraft. The power pod includes at least one interface that is defined by at least one projection and at least one recess. A cover removably cooperates with the power pod to allow access to an engine compartment defined by the power pod. The cover is configured to cooperate with the power pod so that the power pod is generally enclosed and buoyant when the cover is engaged with the power pod. At least one sponson, float, or hull portion that is preferably generally watertight and buoyant removably cooperates with the power pod. The sponson includes an engagement structure that is defined by at least one projection and at least one recess such that the engagement structure of the at least one sponson and the at least one interface of the power pod are translatable relative to one another to index a position of the at least one sponson relative to the power pod and generate a physical interference between the at least one sponson and the power pod when the two are connected to one another. In a preferred embodiment, the power pod is constructed to cooperate with a plurality of sponsons, floats, or supplemental hull portions to define a shape of an operable watercraft. The interface of the power pod can be provided in any number of shapes that provide a geometrically overlapping construction for securing one or more sponsons to the power pod.

In a preferred embodiment, one of more of the auxiliary systems, such as a fuel reservoir or tank, an oil reservoir or tank, a battery system, supplemental floatation devices, personal devices, or other marine type accessories such as whistle, a flare, a mirror, tow rope, etc. are disposed remote from the power pod thereby limiting the weight associated with the power pod. Preferably the auxiliary systems are disposed in one or more of the sponsons that removably cooperate with the power pod. One or more tool-less connections are preferably provided to allow convenient and expedient connection of the power pod and the overall operational systems of the watercraft.

Another feature includes providing movable or removable wheels attached to the power pod. This allows a single operator to effortlessly disassemble the personal watercraft, transport the power pod, and carry or transport the weight associated with the power pod and sponson(s) to and from the recreation area without necessitating costly moving equipment. Alternatively, if the operator is physically capable, the operator may transport the entire assembled personal watercraft by rolling it on the attached wheels, without disassembling the unit.

In describing the preferred embodiment of the invention which is illustrated in the drawings, specific terminology will be referred to for the sake of clarity. However, it is not intended that the invention be limited to the specific terms so selected and it is to be understood that each specific term includes all technical equivalents which operate in a similar manner to accomplish a similar purpose. For example, the words "connected", "attached", or terms similar thereto are often used. They are not limited to direct connection but include connection through other elements where such connection is recognized as being equivalent by those skilled in the art.

2. Detailed Description of Preferred Embodiments

Figure 2:
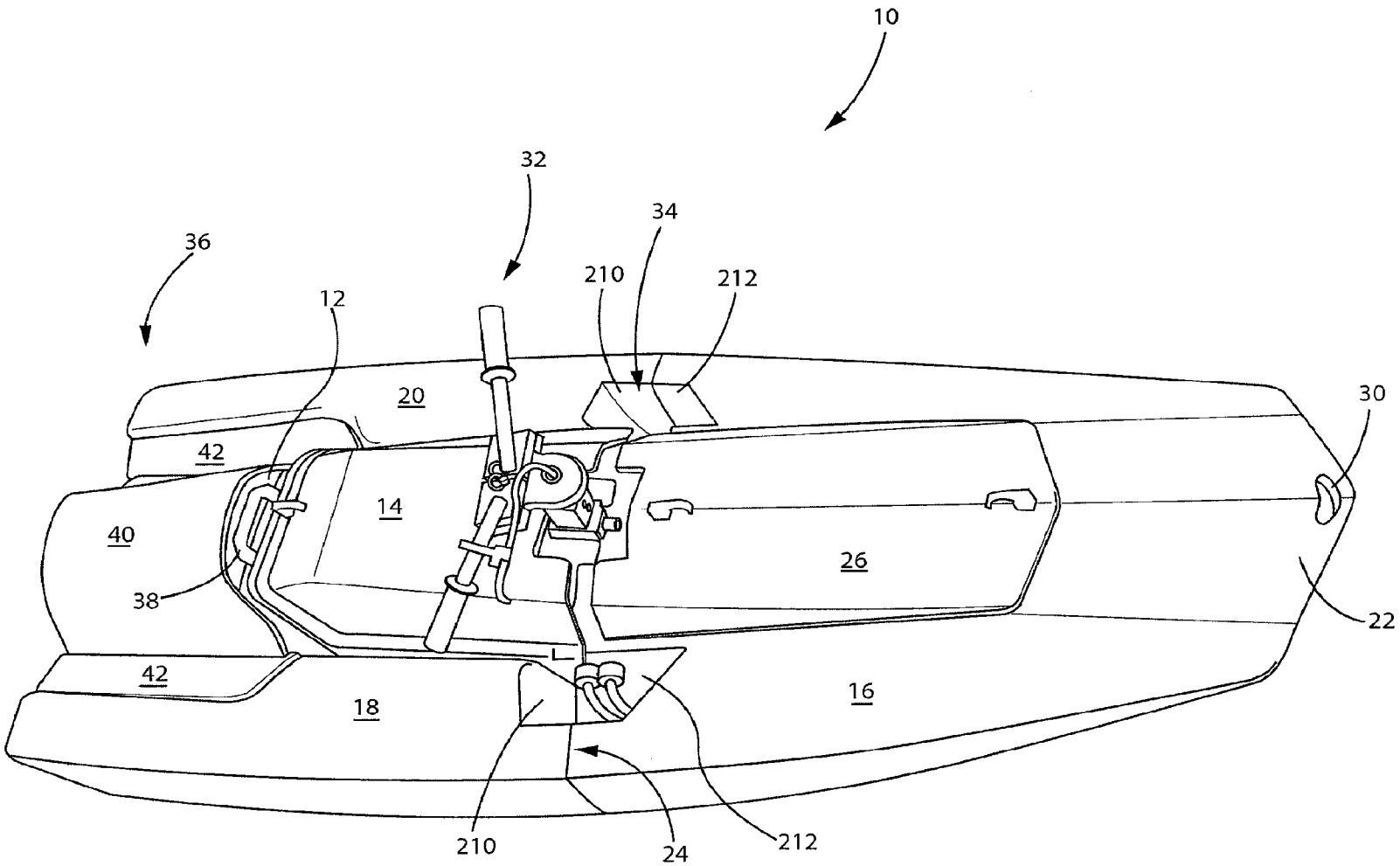
FIG. 2 is a front top perspective view of the watercraft shown in FIG. 1.
Figure 3:
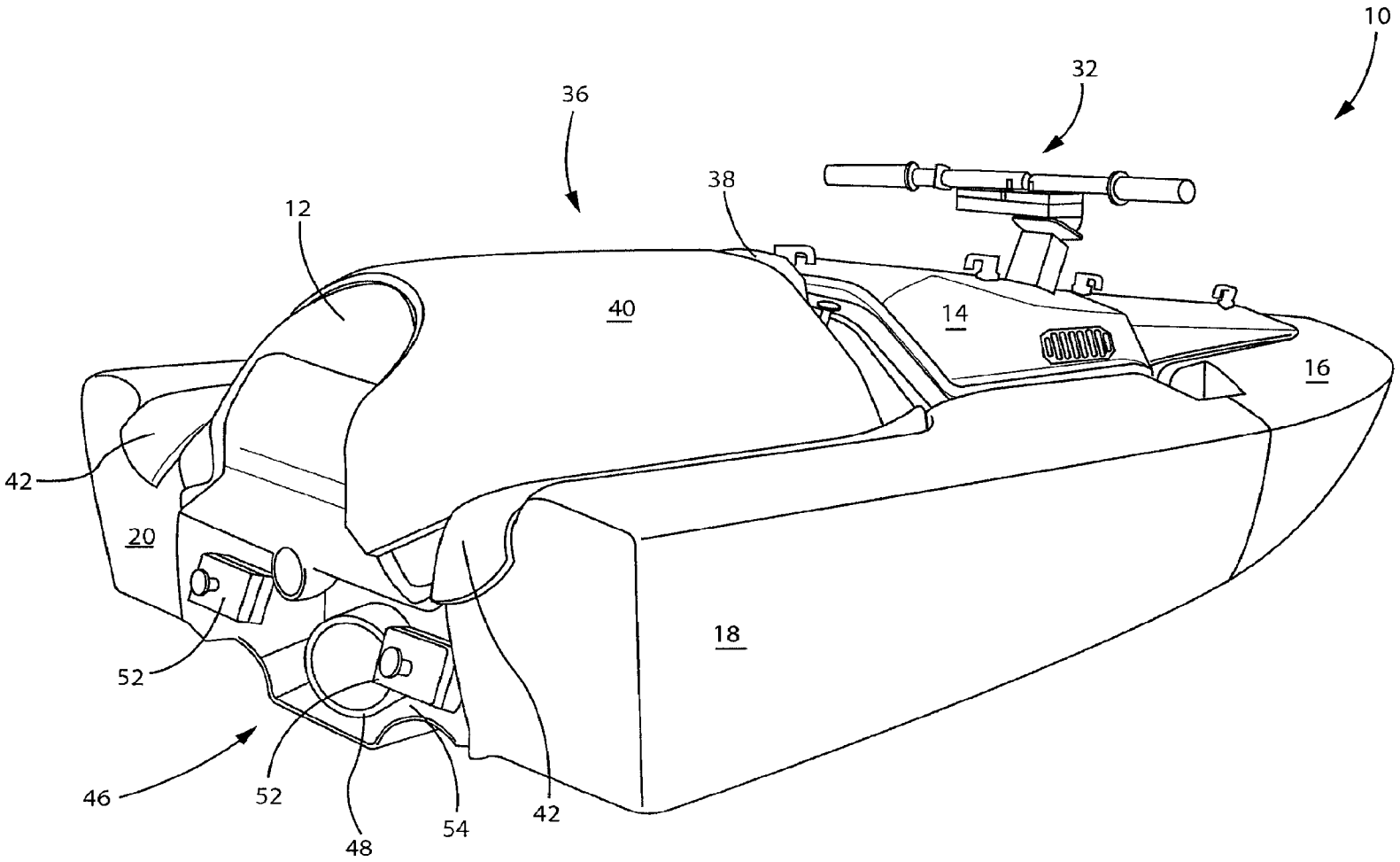
FIG. 3 is a side rear perspective view of the watercraft shown in FIG. 1.

FIGS. 1-3 show a personal watercraft apparatus or watercraft 10 according to the present invention. Watercraft 10 includes a power pod 12 with a removable power pod cover 14. As explained further below, power pod 12 houses a power plant, such as an internal combustion engine or motor, and a propulsion unit or pump associated with in-use water environment operation watercraft 10. Watercraft 10 includes a first removable hull portion, float, sponson or forward sponson 16 and port and starboard side hull portions, floats, or sponsons 18, 20 that each removably cooperate with power pod 12. Although described herein as cooperating with three removable sponson or float portions, it is appreciated that power pod 12 could be constructed to cooperate with other numbers of removable hull or sponson portions and/or is constructed to removably cooperate with hull portions having shapes other than that which is shown.

Forward sponson 16 includes a forward facing end 22, a rearward or aft facing end 24, and a cover 26 that removably cooperates therewith. As explained further below, forward sponson 16 removably cooperates with power pod 12, starboard sponson 18, and port sponson 20 to form a personal watercraft configured to support a single operator and/or an operator and one or more passengers. Forward sponson 16 preferably includes a grab or handle 30 that is defined by the shape of forward sponson 16. Handle 30 is preferably positioned proximate forward end 22 of forward sponson 16 and facilitates non-use manual transportation of forward sponson 16 and/or other sponsons and/or a power pod connected thereto. That is, handle 30 is shaped to facilitate the convenient transportation of forward sponson 16 and/or the entirety of watercraft 10.

Power pod 12 includes a steering assembly 32 positioned proximate a forward end 34 thereof. A support area 36 is positioned generally rearward of cover 14 of power pod 12 and steering assembly 34. A grab or handle 38 is positioned generally between cover 14 and support area 36. Support area 36 preferably includes a pad 40 and is shaped to generally accommodate an operator in various positions relative to watercraft 10. As explained further below, support area 36 of power pod 12 and/or sponsons 18, 20, in cooperation with a steering assembly 32 are constructed such that watercraft 10 is operable by an operator in generally standing positions, seated or kneeling positions, and/or more generally horizontal, prone, or trailing positions of the operator relative to watercraft 10. Sponsons 18, 20 each include a contour 42 positioned generally adjacent support area 36 when sponsons 18, 20 are attached thereto such that support area 36 and sponson 18, 20 are contoured to accommodate anatomy of the user such as a operators foot, the upper arms, when the operator is oriented in a more prone position, and/or lower leg portions such as the shins and knees of a seated operator. Such a construction allows the operator to attain various positions during use of watercraft 10.

Figure 4:
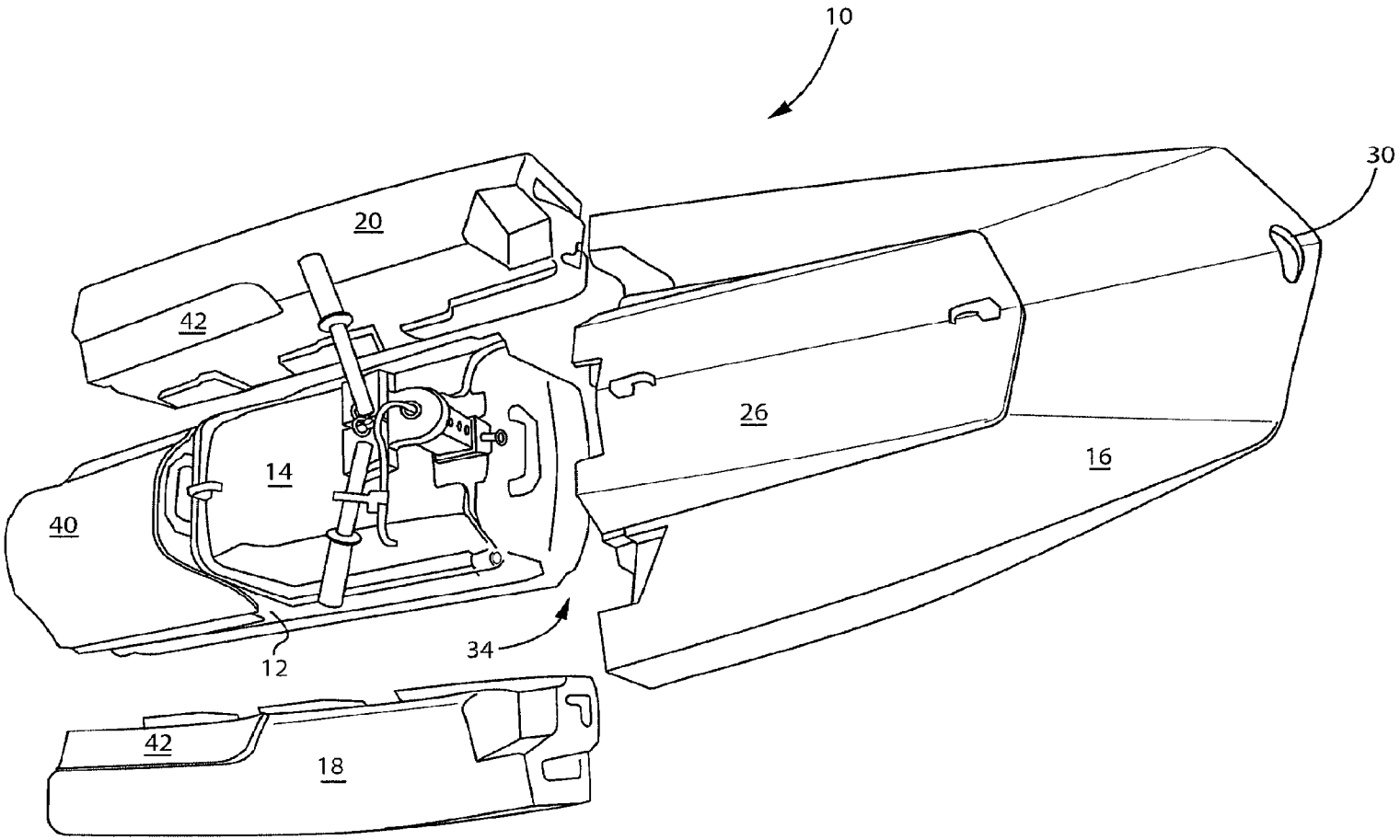
FIG. 4 is a top plan perspective exploded view of the watercraft shown in FIG. 1.
Figure 5:
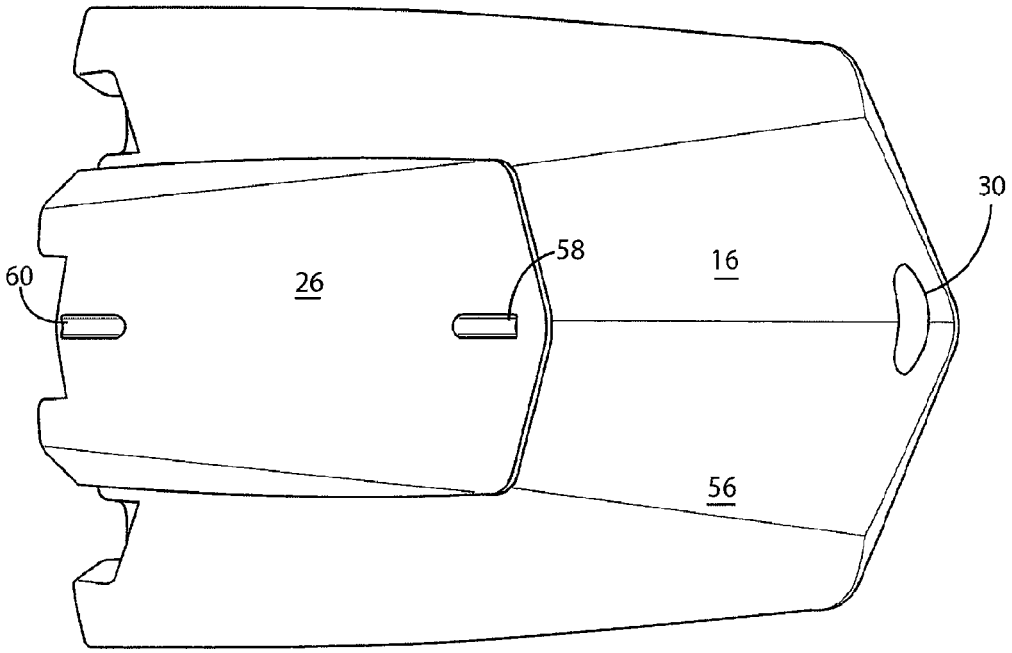
FIG. 5 is a view similar to FIG. 4 of a forward sponson portion of the watercraft shown in FIG. 4.
Figure 6:
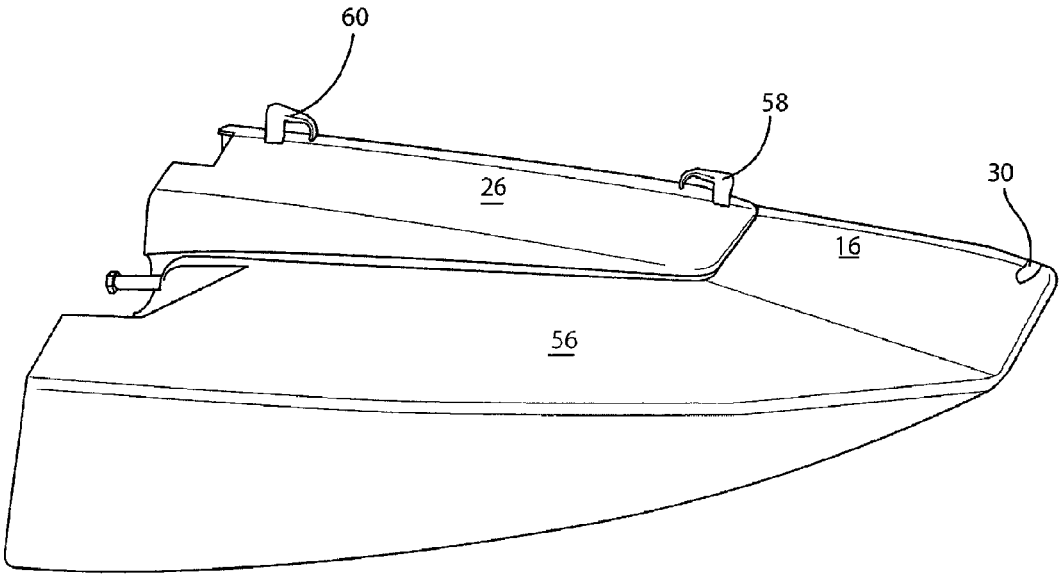
FIG. 6 is a side perspective view of the forward sponson shown in FIG. 5.
Figure 7:
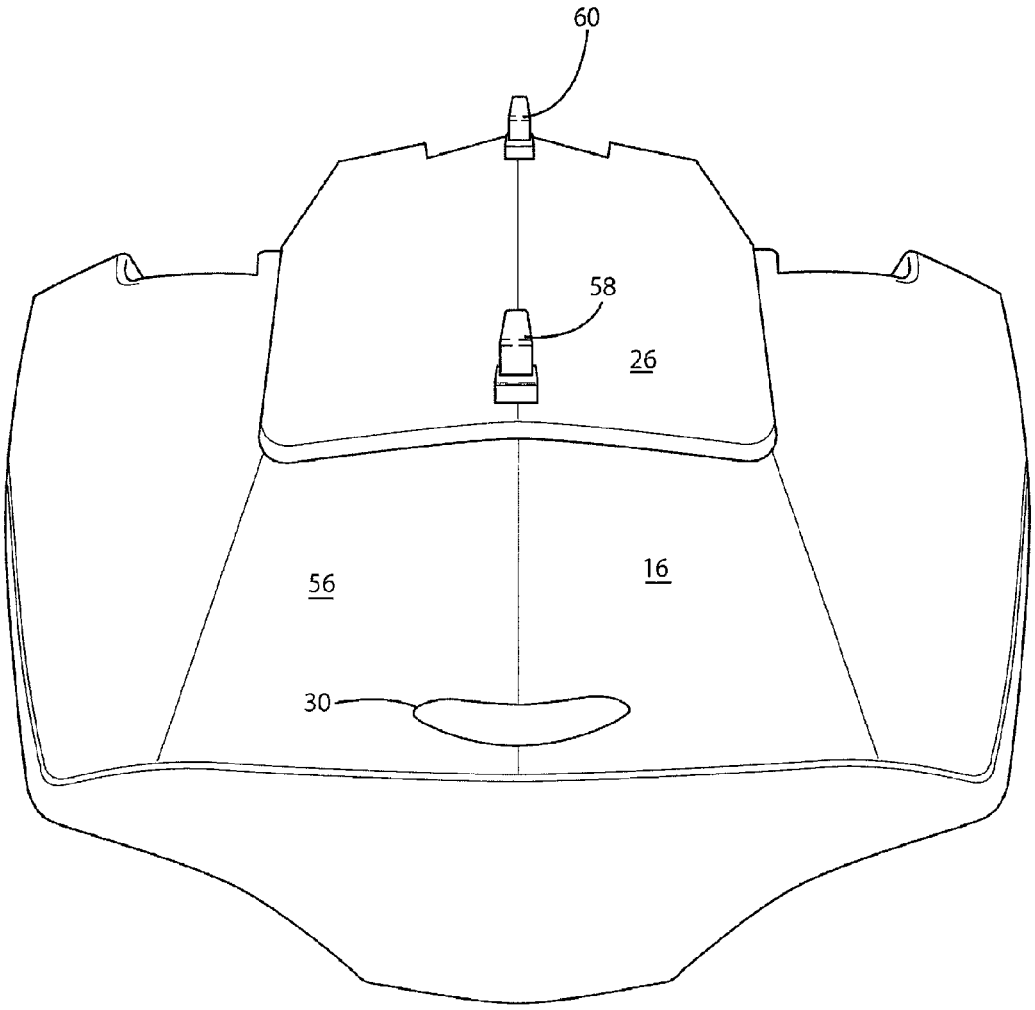
FIG. 7 is forward perspective view of the forward sponson shown in FIG. 5.

As shown in FIG. 3, power pod 12 includes a rear facing end 46 associated with a steerable nozzle assembly 48 associated with propulsion of watercraft 10. Power pod 12 includes a first mount 50 and a second mount 52 that are attached to opposite lateral sides of a hull 54 of power pod 12. Mounts 50, 52 are constructed to removably cooperate with one or more wheel assemblies (not shown) to facilitate partially ground supported transportation of power pod 12 and/or watercraft 10. It is appreciated that mounts 50, 52 could be configured to cooperate with a wheel assembly in a manner wherein the wheels are merely stowable rather than removable from watercraft 10. As shown in FIG. 4, sponsons 16, 18, 20 are constructed to removably cooperate with power pod 12 to allow selective separation of power pod 12 from the one or more sponsons 16, 18, 20 associated therewith. As used herein, it should be appreciated that each of power pod 12 and sponsons 16, 18, 20 include hull or hull portions associated with the formation of a resultant watercraft. Preferably, each of the respective hull, sponson portions, and/or power pod 12 are independently buoyant. Although shown as a personal watercraft, it is appreciated that power pod 12 is constructed to cooperate with a number of hull portions for manipulating the shape of the resultant watercraft. That is, power pod 12 can be configured to cooperate with removable hull portions so as to define a watercraft having a shape of a personal watercraft, a boat, a rigid inflatable boat, a canoe, a kayak, or a catamaran, for example.

FIGS. 5-8 show forward sponson 16 disengaged from power pod 12 and additional sponson 18, 20. Cover 26 removably cooperates with a hull 56 of forward sponson 16. A first latch 58 and a second latch 60 are attached to cover 26 and operationally cooperate with a hull 56 associated with forward sponson 16 to provide a sealed interaction between cover 26 and hull 56. Preferably, latches 58, 60 are biased toward a closed position and require positive interaction with the user or operator of watercraft 10 to effectuate manipulation thereof for removal of cover 26. Manipulation of latches 58, 60 allows cover 26 to be pivotably or completely removed from hull 56 of forward sponson 16. Aft facing end 24 of forward sponson 16 includes an index surface 64 associated with orienting forward sponson 16 relative to power pod 12 and sponsons 18, 20. Surface 64 includes a center portion 66 and opposite lateral portions 68, 70 wherein center portion 66 is shaped to cooperate the forward facing end the power pod 12 and lateral portion 68, 70 are shaped to cooperate with alternate respective sponson 18, 20. As explained further below, the geometric physical interaction of sponson 16 with power pod 12 secures sponsons 18, 20 relative to power pod 12 via interaction of one or more latch assemblies that extend between forward sponson 16 and power pod 12.

Figure 8:
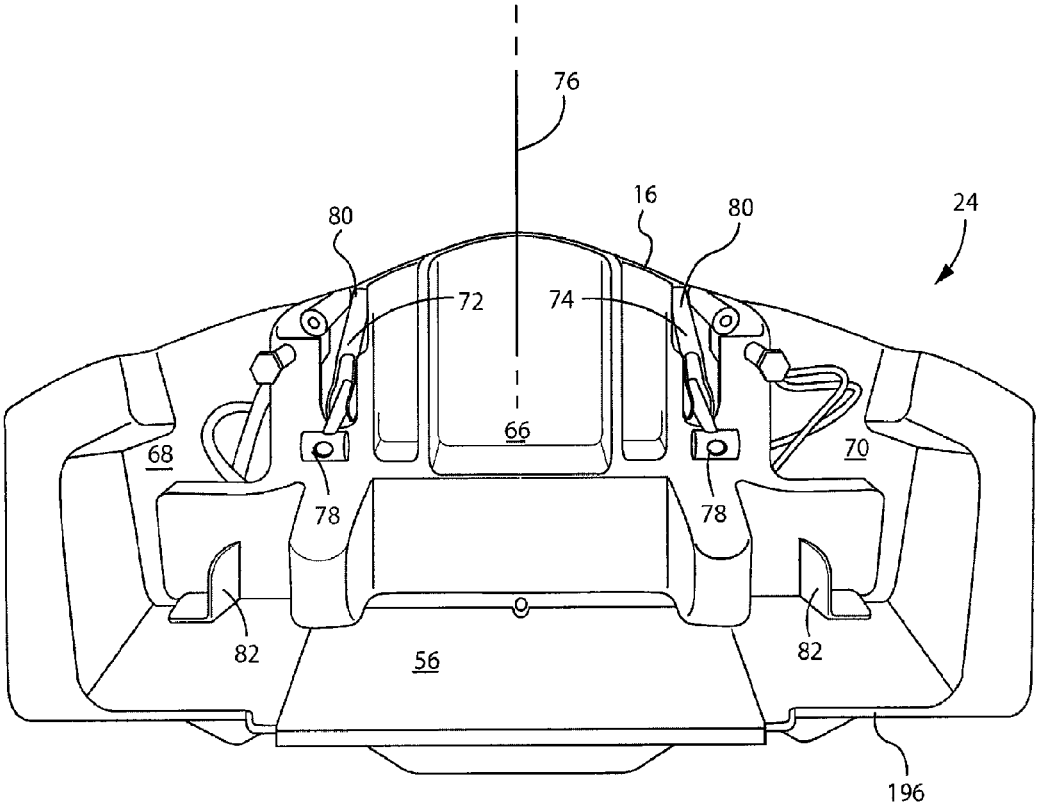
FIG. 8 is a rear elevation view of the forward sponson shown in FIG. 5.
Figure 9:
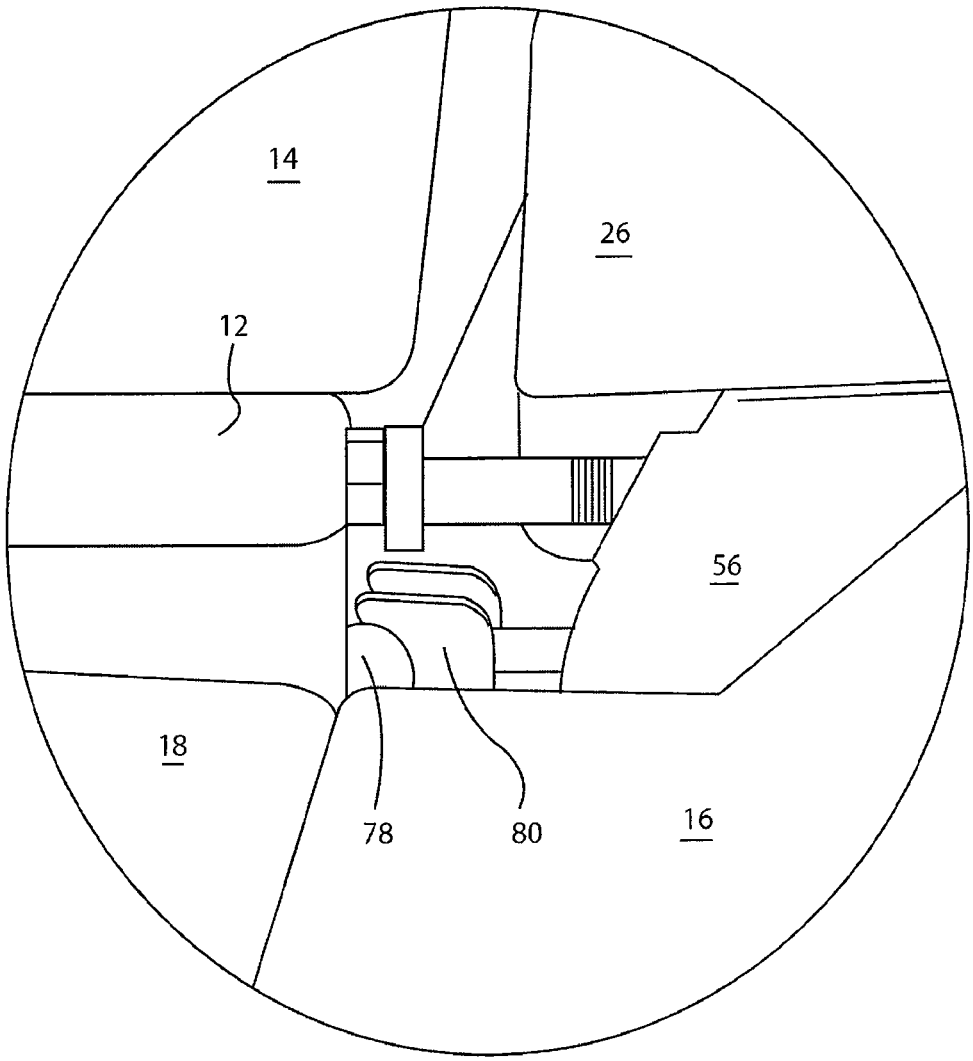
FIG. 9 is a partial side elevation view of the forward sponson engaged with a power pod of the watercraft shown in FIG. 1.

Referring to FIGS. 8-9, a first latch assembly 72 and a second latch assembly 74 are attached to hull 56 of forward sponson 16 and operable to removably cooperate with a forward facing end of power pod 12. Latch assemblies 72, 74 are preferably positioned laterally outboard of a lateral centerline 76 of hull 56 of forward sponson 16. Each latch assembly 72, 74 includes a catch 78 that is movably connected to a lever 80 associated with the respective lever assembly 72, 74. Preferably, each catch 78 adjustably cooperates with the respective latch to define a pressure associated with operation of the respective lever 80 and thereby the bias of forward sponson 16 into engagement with power pod 12. Latches 80 are movable to manipulate the position of catches 78 relative to hull 56 along longitudinal centerline 76 of hull 56 and power pod 12. One or more optional reinforcements 82 are associated with outboard portions 68, 70 of hull 56. Reinforcements 82 are shaped to slidably cooperate with one or both of power pod 12 and/or sponson 18, 20 and limit translation between the respective hull portions in direction not aligned with longitudinal axis 76. As shown in FIG. 9, catches 78 removably cooperate with a respective mount 80 associated with power pod 12 such that manipulation of the respective lever 80 provides a compressive force along the longitudinal axis 76 of watercraft 10 between hull 56 of forward sponson 16 and power pod 12. When closed, latch assemblies 72, 74 and mounts 80 provide a secured and robust connection between sponson 16 and power pod 12.

Figure 10:
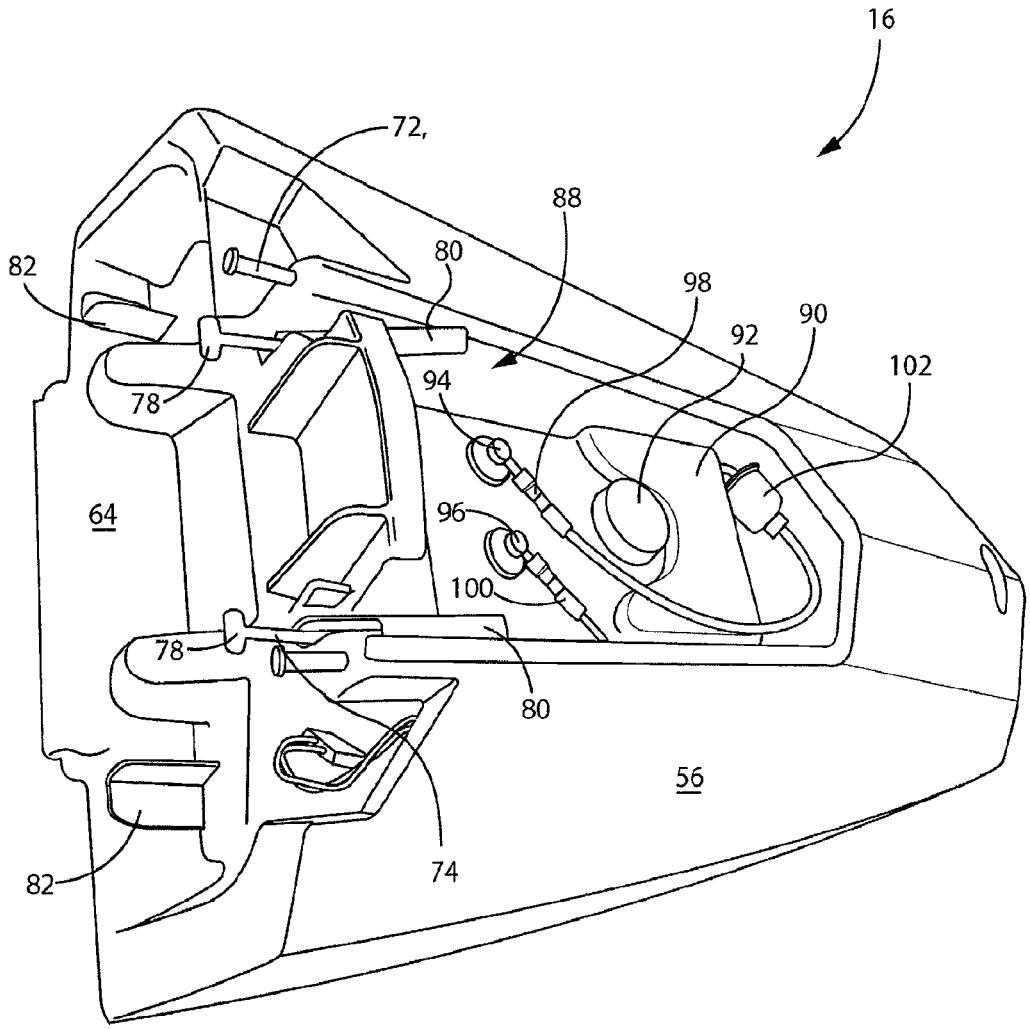
FIG. 10 is a top rear perspective view of the forward sponson shown in FIG. 5 with a cover removed therefrom.
Figure 11:
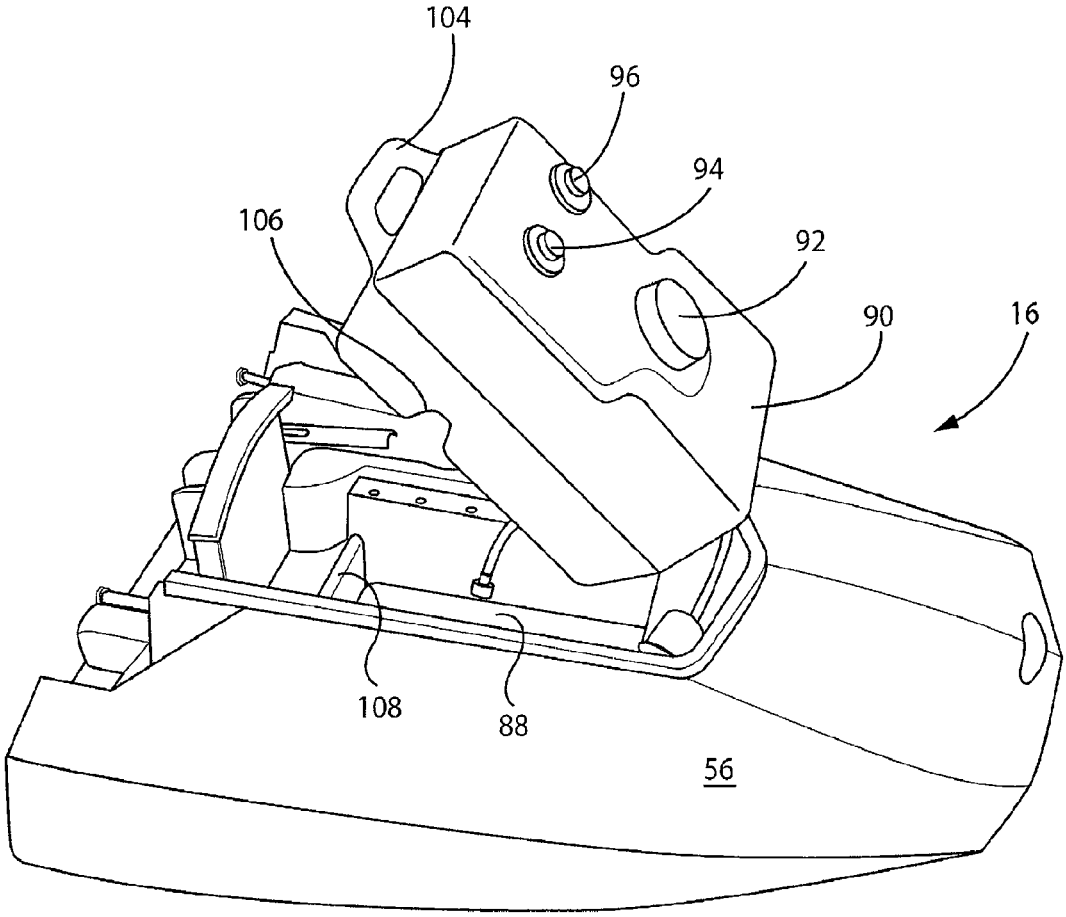
FIG. 11 is a view similar to FIG. 6 of the forward sponson shown in FIG. 10 with a fuel tank partially removed therefrom.
Figure 12:
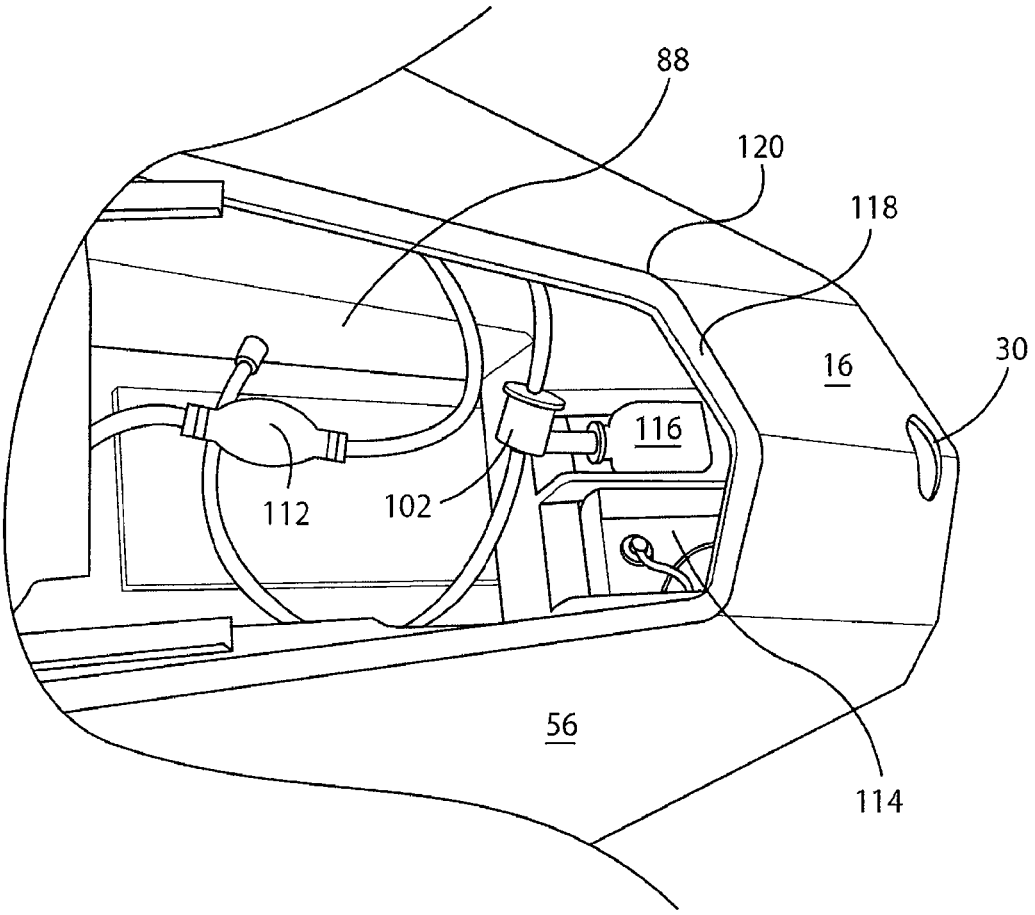
FIG. 12 is a top rear perspective view of the forward sponson shown in FIG. 11 with the fuel tank removed therefrom.

FIGS. 10-12 show forward sponson 16 with cover 26 removed from hull 56. Hull 56 includes a cavity 88 shaped to receive one or more supplemental systems associated with operation of power plant contained within power pod 12 as described further below. For instance, cavity 88 can be shape to receive a fuel reservoir or tank 90 associated with operation of an internal combustion engine associated with power pod 12. Fuel tank 90 removably cooperates with cavity 88 of forward sponson 16. Tank 90 includes a fill port 92, an outlet port 94, and a return port 96, associated with circulation of a combustion fuel for the engine type power plant associated with power pod 12. One or more tool-less connectors 98, 100, commonly referred to as quick-connectors, are provided to allow the expedient removal and/or connection of fuel tank 90 from sponson 16.

Preferably, ports 92, 94, 96 and connectors 98, 100 are constructed to both provide a sealed termination of the respective ports and connectors when fuel tank 90 is removed from hull 56 and allow a generally uninterrupted fluid flow when ports 94, 96 and connectors 98, 100 are engaged with one another. Such a construction allows convenient sealed transport of fuel tank 90 as well as non-leaking of the fuel associated with the fuel system when tank 90 is removed from hull 56. When provided in such a configuration, the fuel system associated with fuel tank 90 preferably includes a filter 102 to limit the communication of any particulate debris between fuel tank 90 and the internal combustion engine associated with power pod 12. Tank 90 preferably includes a handle portion 104 and one or more contours 106 that are shaped to cooperate with a corresponding contour 108 associated with cavity 88 of hull 56. Contours 106, 108 and handle 104 are shaped to cooperate with cavity 88 and cover 26 so as to limit translation of fuel tank 90 relative to cavity 80 during operation of watercraft 10. As shown in FIG. 12, the fuel system associated with fuel tank 90 and the engine based power plant can include a primer device such as a primer bulb 112 associated with the initial communication of the combustion fluid from fuel tank 92 to the internal combustion engine associated with power pod 12. Such a configuration simplifies the starting operation associated with engine based power pods.

In addition the fuel tank 90, cavity 88 of hull 56 is also shaped to cooperate and/or receive supplemental engine and/or watercraft accessories. For instance, a power source, such as a battery 114 can be removably associated with hull 56 and configured to communicate an electrical signal associated therewith from forward sponson 16 to power pod 12. Battery 114 can be usable for electric starting operations associated with engine based power pods and/or be used for propulsion energy when the power plant associated with power pod 12 is motor based. Forward sponson 16 can also be shaped to accommodate a fire suppression device, such as a fire extinguisher 116, and/or supplemental flotation devices, such as a life jacket or the like. A seal 118 extends about a perimeter 120 of the opening associated with cavity 80 and cooperates with the underside of cover 26 to provide a sealed interaction when cover 26 is engaged with hull 56 of forward sponson 16. Such a construction maintains a fluid isolation of the cavity associated with hull 56 from the operating environment.

Figure 13:
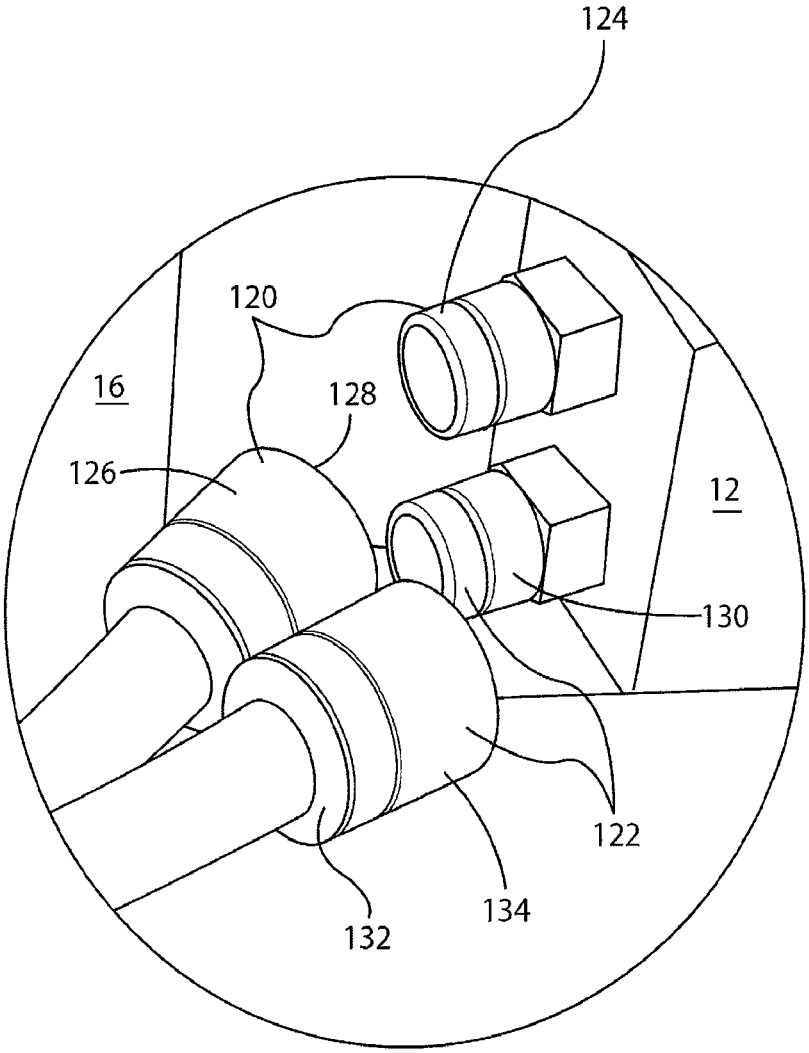
FIGS. 13 and 14 are a detailed perspective views of tool-lessly operable connectors that extend between the power pod and the forward sponson.
Figure 14:
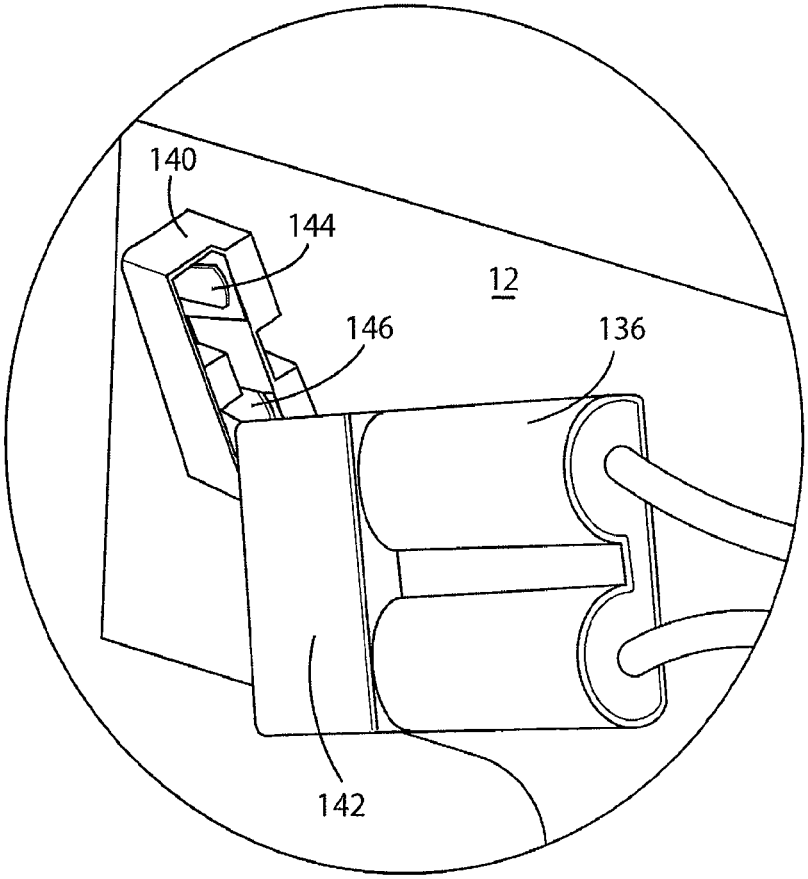

Referring to FIGS. 13 and 14, one or more connectors and preferably tool-lessly operable connectors are provided between forward sponson 16 and power pod 12 of watercraft 10. As shown in FIG. 13, the fuel system of watercraft 10 includes a first quick connect 120 and the second quick connect 122 that establishes a fluid circulation loop associated with the fuel system of watercraft 10. Quick connect 120 includes a male portion 124 and a female portion 126 that removably cooperate with one another. Female portion 126 includes a movable collar 128 that allows the selective connection and/or separation of quick connect 120. In a similar manner, quick connector 122 includes a male portion of 130 and a female portion 132 that also includes a movable collar 134 such that female portion 132 when male portion 130 of quick connect 122 can be quickly and efficiently coupled and decoupled during utilization of watercraft 10. Preferably, the respective portions of quick connect assemblies 120, 122 cooperate with one another in a manner that provides a sealed interface whether the respective portions are connected or disconnected.

FIG. 14 shows a tool-lessly operable electrical connection 136 associated with communicating electrical power from battery source 114 associated with forward sponson 16 to power pod 12. Connection 136 includes a first portion 140 and a second portion 142 that removably cooperate with one another to electrically couple and decouple a first conductor of 144 and a second conductor 146 associated with the electrical system between forward sponson 16 and power pod 12. Preferably, each of connectors 120, 122, 136 are operable from locations beyond the periphery or from locations exterior to forward sponson 16 and power pod 12. Such a construction allows the expedient interaction with connectors 120, 122, 136 and allows expedient visual inspection of the status of the connectors as being connected and/or de-connected with respect to the respective fuel and electrical systems associated therewith. It is appreciated that sponson 16 may be provided one or both of the fuel and/or battery systems as a function of the underlying operation associated with power pod 12. It is further appreciated that sponson 16 may include additional consumable and/or rechargeable systems such as an oil reservoir or the like for communicating other fluids between the remote sponsons such as forward sponson 16 and power pod 12. It is further appreciated that although the consumable materials are shown as being contained in the forward sponson 16, the consumable systems may be disposed in other sponsons. Preferably, the refillable or rechargeable consumables are provided in hull portions and/or sponsons remote from power pod 12. It is further appreciated that one or more of sponsons 16, 18, 20 can be configured to include one or more other marine accessories such as supplemental floatation devices, personal devices, a whistle, a flare, a mirror, tow rope, etc.

Figure 15:
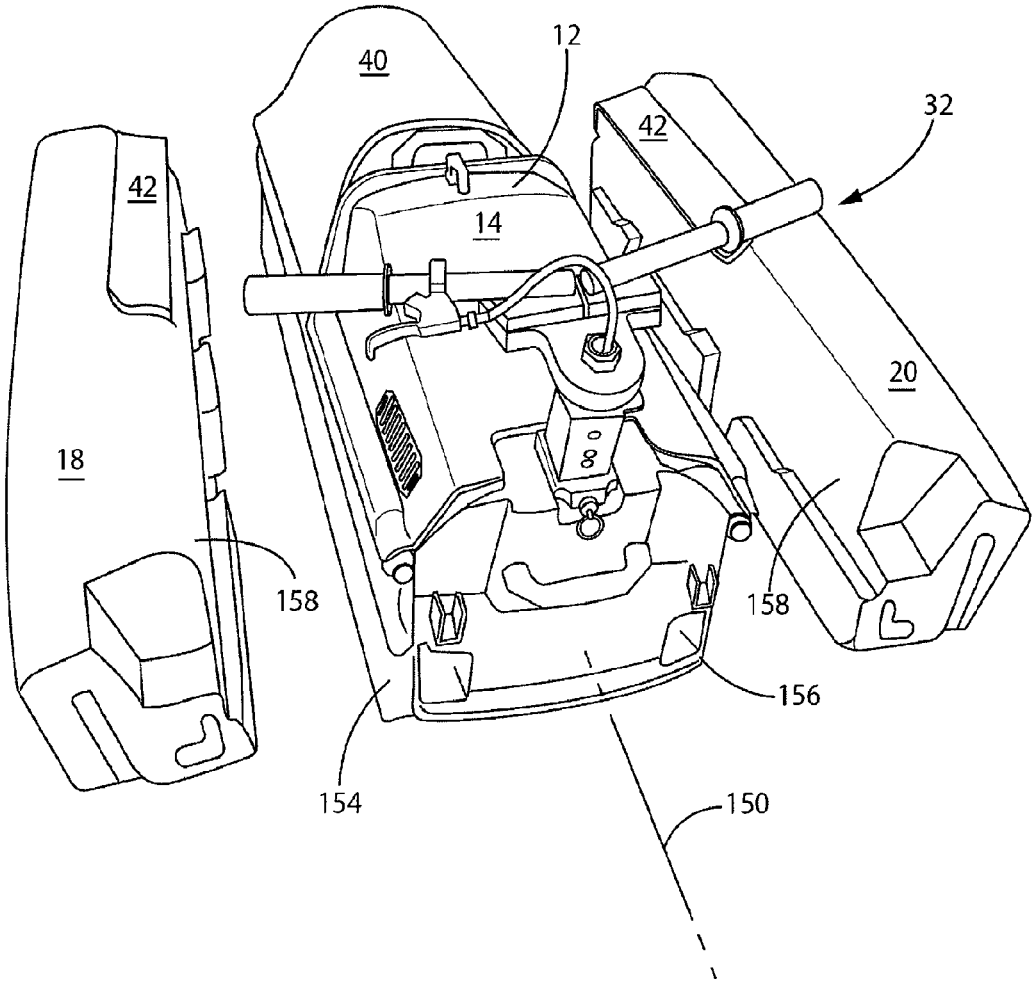
FIG. 15 is a front top perspective view of the exploded power pod shown in FIG. 4 with the forward sponson removed therefrom.
Figure 16:
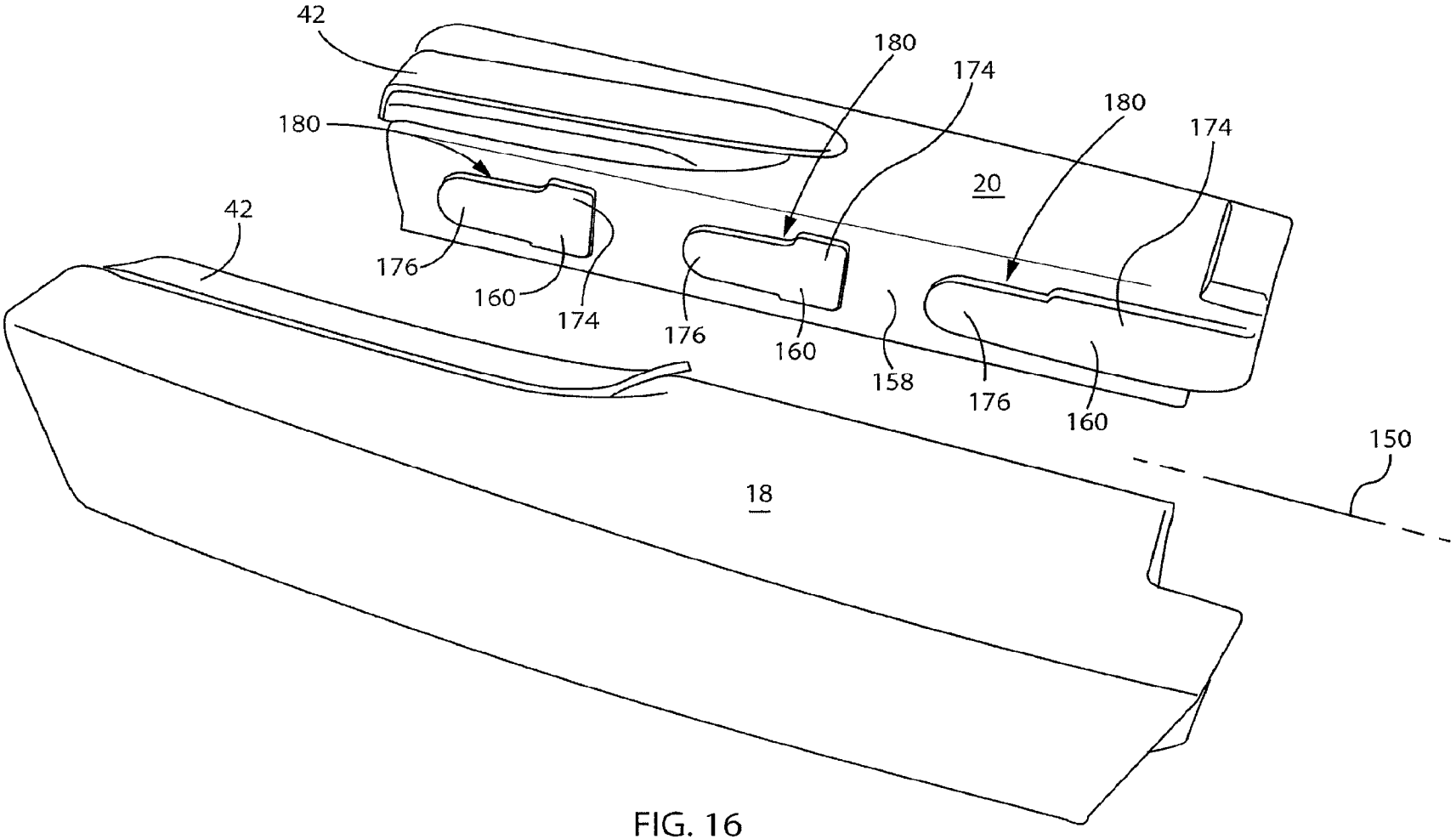
FIG. 16 is a side perspective view of the pair of side sponsons shown in FIG. 15.
Figure 17:
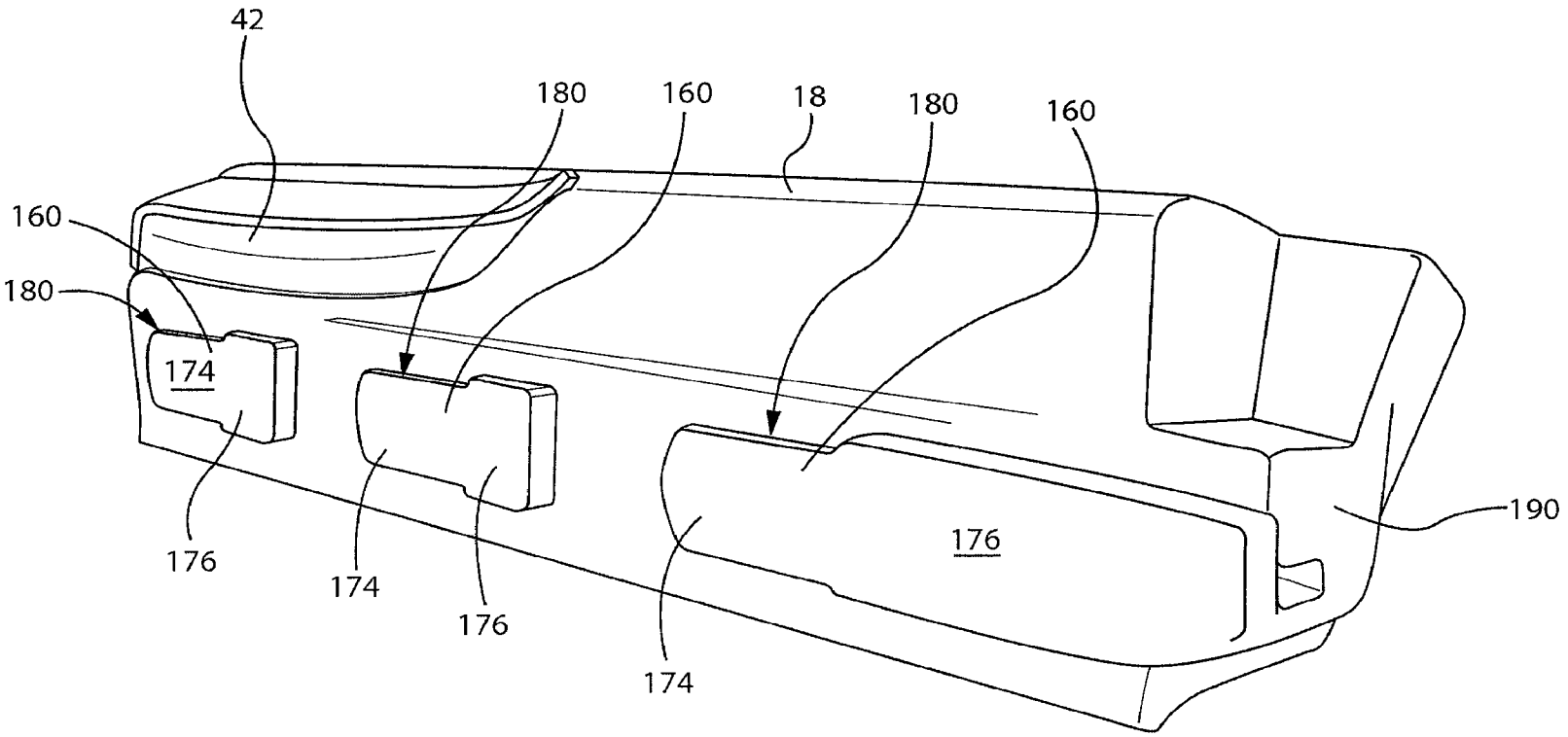
FIG. 17 is a forward side perspective elevation view of one of the side sponsons shown in FIG. 15.
Figure 18:
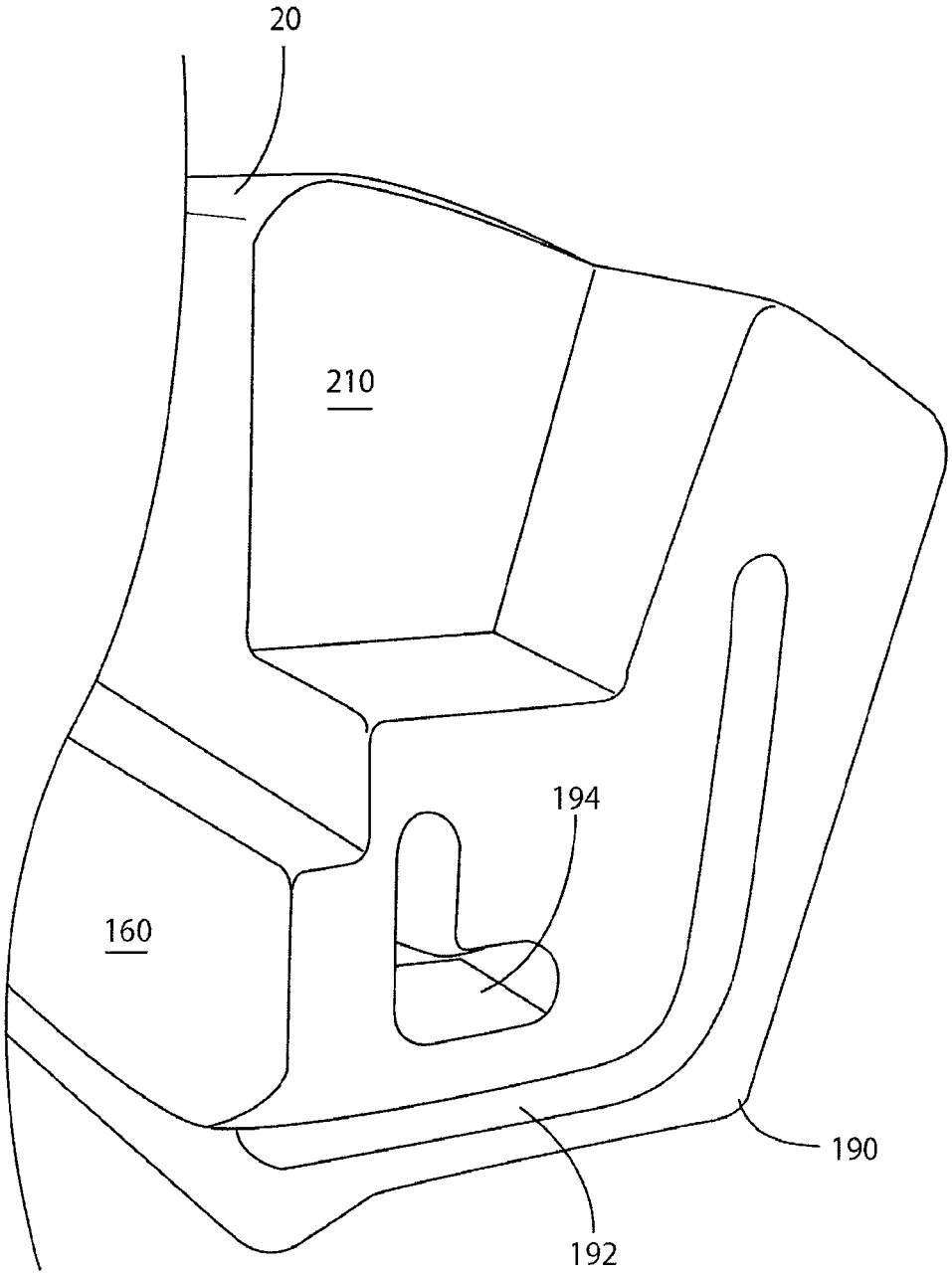
FIG. 18 is a view similar to FIG. 17 and shows a forward facing end of one of the side sponsons.
Figure 19:
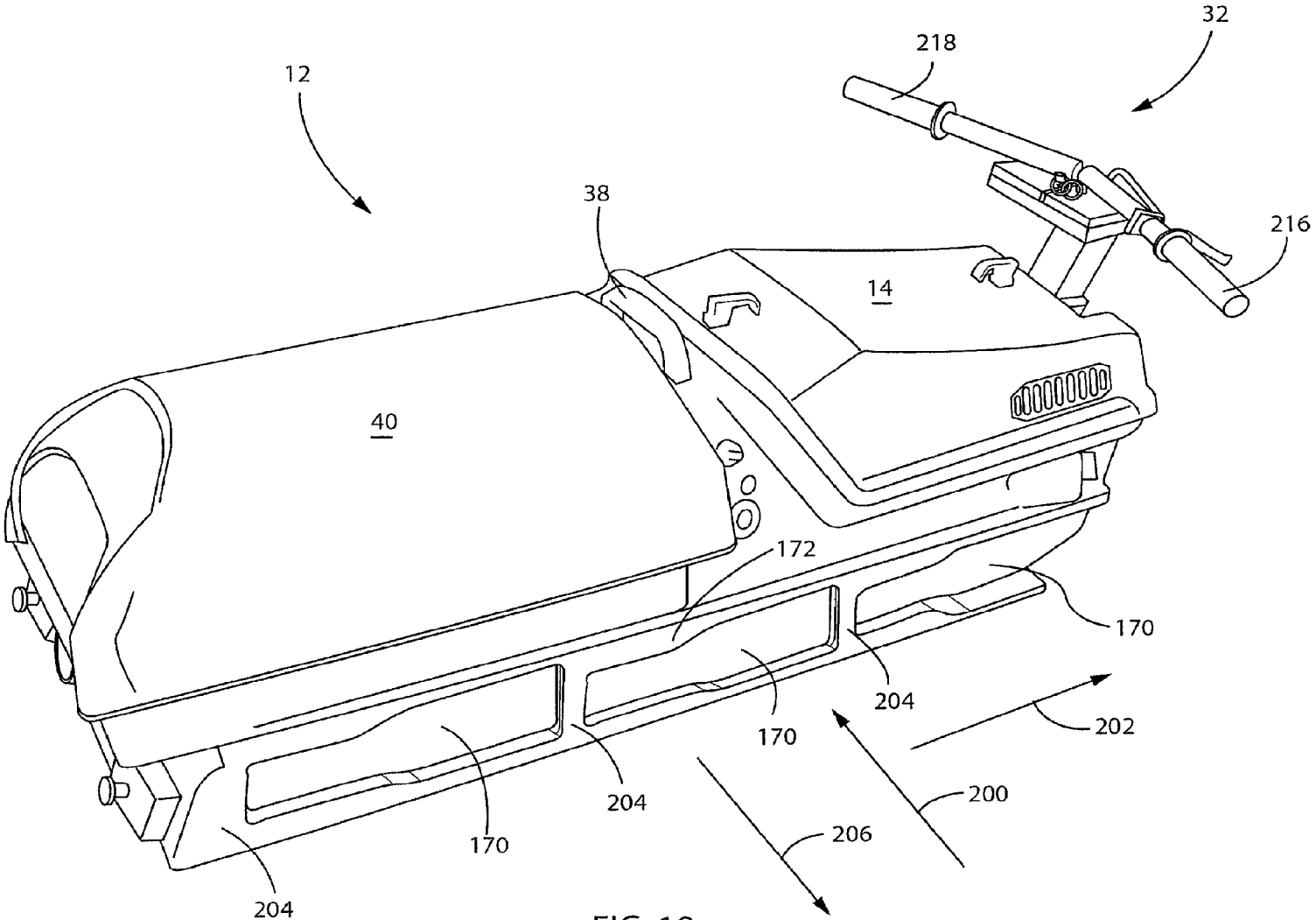
FIG. 19 is a rear top side perspective view of the power pod shown in FIG. 4 with the supplemental sponsons removed therefrom.
Figure 20:
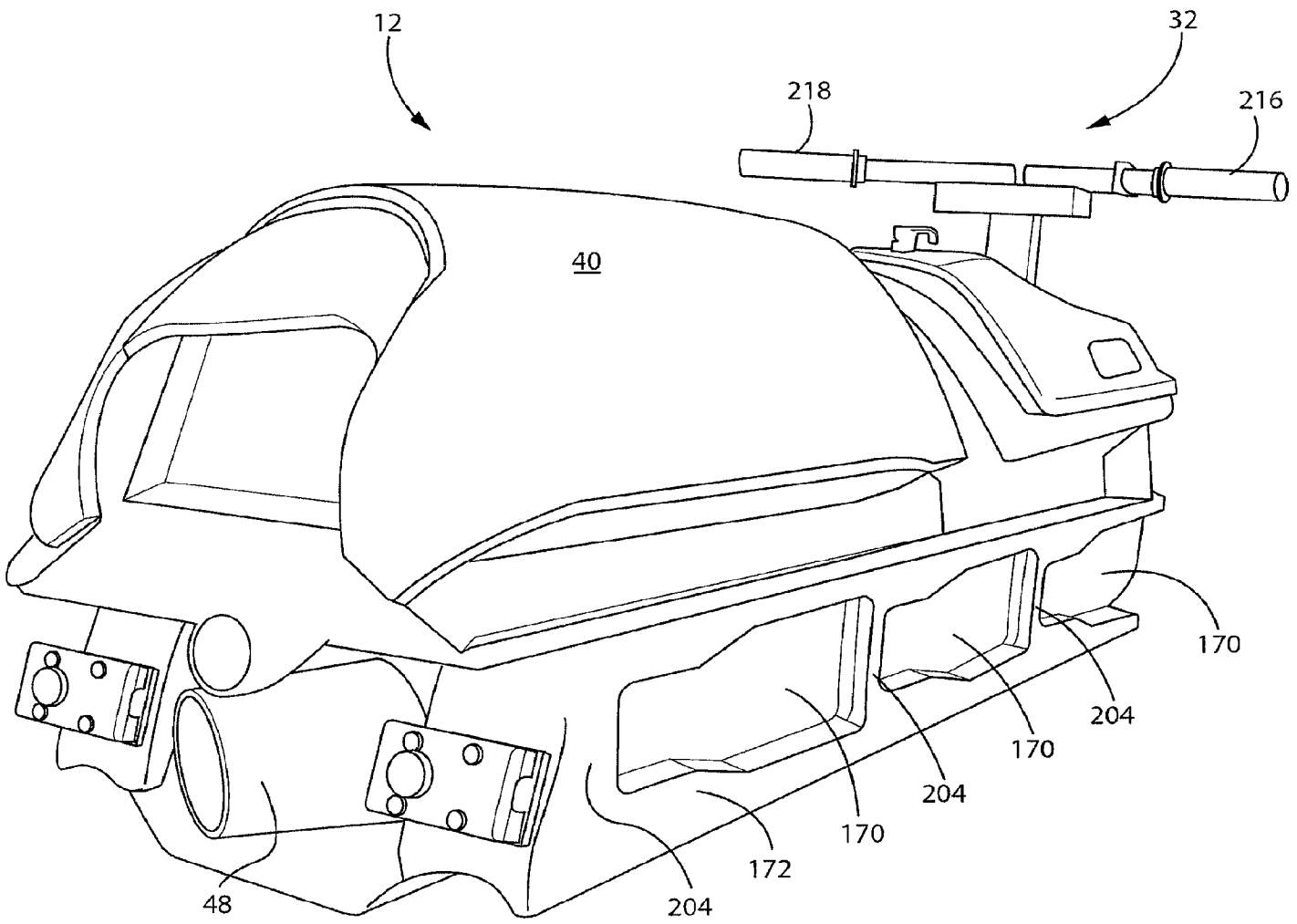
FIG. 20 is a more rearward perspective view of the power pod shown in FIG. 4 and shows a steerable discharge nozzle associated with operation of the power pod.

FIGS. 15-20 show various views of power pod 12 and aft port and aft starboard sponsons 18, 20 removed or otherwise disengaged therefrom. As shown in FIG. 15, sponsons 18, 20 removably cooperate with alternate lateral sides 154, 156 of power pod 12. Inboard facing side 158 of each sponson 18, 20 includes one or more projections 160 that are shaped to removably cooperate with one or more cavities 170 (FIGS. 19-20) associated with a hull 172 of power pod 12. As shown in FIGS. 16-18, each projection 160 includes a first portion 174 and a second portion 176. A gap 180 is defined between second portions 176 of projections 160 and adjacent portions of the respective sponson 18, 20. It should be appreciated that the inboard facing surfaces 158 of respective sponsons 18, 20 are generally mirror images of one another relative to the longitudinal centerline 150 associated with power pod 12 of watercraft 10. However, it is appreciated that the cooperation between sponsons 18, 20 and power pod 12 need not be so constructed.

Referring to FIGS. 17 and 18, forward facing end 190 of each of sponson 18, 20 includes one or more contours or channels 192, 194 that are shaped to slidably interact with surfaces or structures such as a rib 196 (FIG. 8) or reinforcements 82 (FIG. 8) associated with forward sponson 16. As explained further below, the geometric interaction between projections 160 of sponson 18, 20 and one or more recesses 192, 194 associated with forward end 190 of the respective sponson 18, 20 with cooperation of forward sponson 16 provides a secure mechanical interface therebetween so as to limit translation of sponsons 18, 20 relative to power pod 12 when forward sponson 16 is secured therewith without any other locking or latching mechanism associated with interacting directly with the respective sponson 18, 20. Providing such a configuration simplifies the assembly and breakdown of watercraft 10 in that only a limited number of latching assemblies 72, 74 are required to be manipulated to effectuate full assembly or breakdown of the underlying watercraft 10.

Referring to FIGS. 17-20, each projection 160 associated with the respective sponson 18, 20 is constructed to slidably cooperate with the corresponding engine compartment or cavity 170 associated with hull 172 of power pod 12. That is, when sponsons 18, 20 are positioned adjacent power pod 12, the respective sponson 18, 20 is translatable in a lateral direction, indicated by arrow 200, such that projections 160 are slidably received in recesses 170 of power pod 12. Relative translation of the sponson 18, 20 relative to power pod 12 in the longitudinal direction, indicated by arrow 202, generates a geometric overlapping interface associated with the cooperation of projections 160 and the respective recesses 170. A rear wall 204 defined by hull 172 of power pod 12 slidably cooperates with gap 180 formed between second portion 176 and the adjacent structure of each respective sponson 18, 20 as power pod 12 is translated in direction 202 relative to the respective sponson 18, 20.

The overlapping physical interference or interaction prevents lateral translation, indicated by arrow 206 of respective sponson 18, 20 relative to hull 172 of power pod 12. The interaction of projections 160 and recesses 170 and the cooperation of forward ends 190 of sponson 18, 20 with rearward facing end 24 of forward sponson 16 generates a compressive force during closure of latch assemblies 72, 74 associated with forward sponson 16 as shown in FIG. 8. The cooperation of each sponson 18, 20 with power pod 12 and forward sponson 16 provides a physical interaction that prevents separation of sponson 18, 20 from power pod 12 when forward sponson 16 is engaged therewith. Such a construction also requires no supplemental latch or locking connection assembly engaged directly between sponson 18, 20 and either of power pod 12 and/or forward sponson 16. Each sponson 18, 20 also includes a forward facing laterally inboard recess 210 that is shaped to cooperate with a corresponding recess 212 (FIG. 2) associated with opposite lateral sides of forward sponson 16. Recesses 210, 212 cooperate with one another to allow an operator to access and manipulate connectors 120, 122, 140 and latch assemblies 72, 74 associated with assembling and disassembling watercraft 10.

Figure 21:
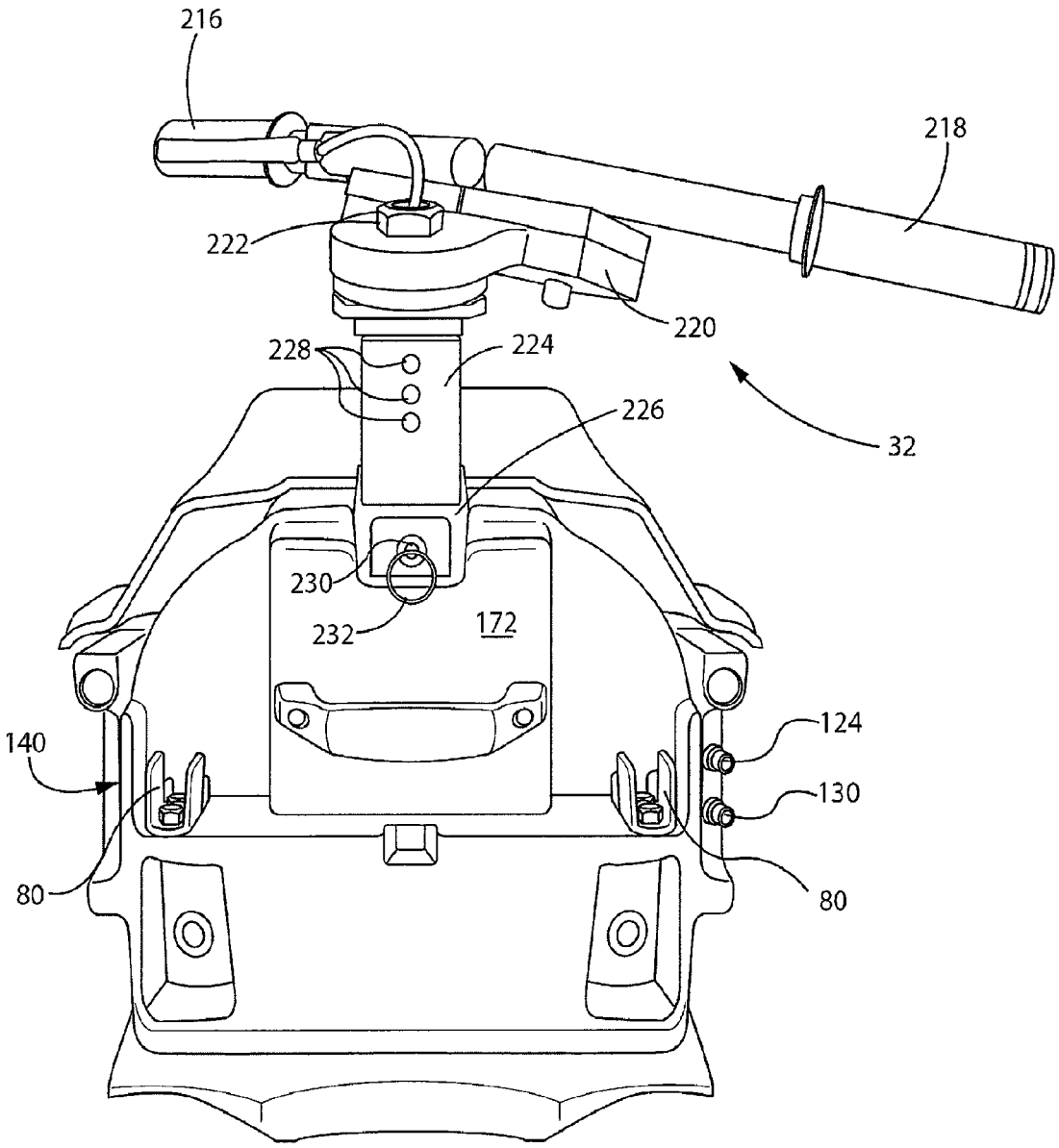
FIG. 21 is a front side elevation view of the power pod shown in FIG. 19.
Figure 21A:
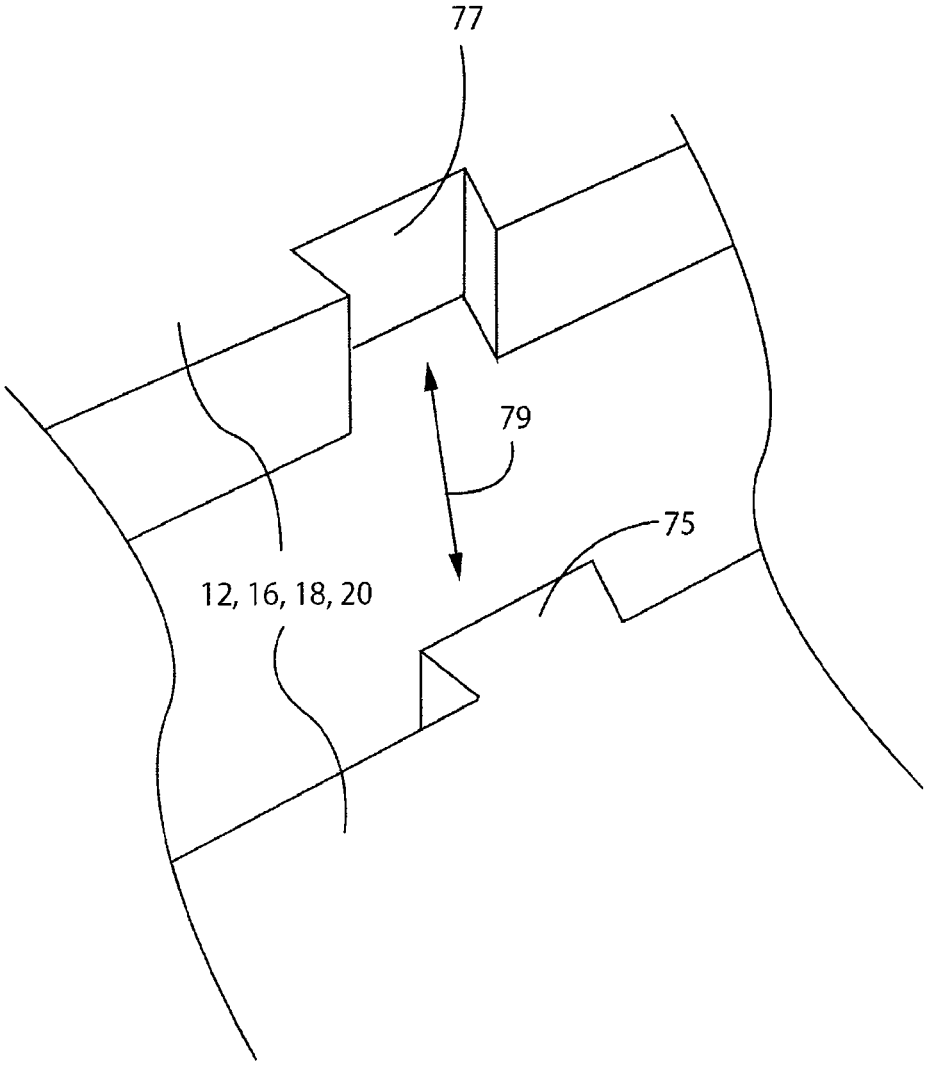
FIG. 21A is a perspective view of an alternate physical interaction between adjacent hull portions of the watercraft shown in FIG. 1.
Figure 22:
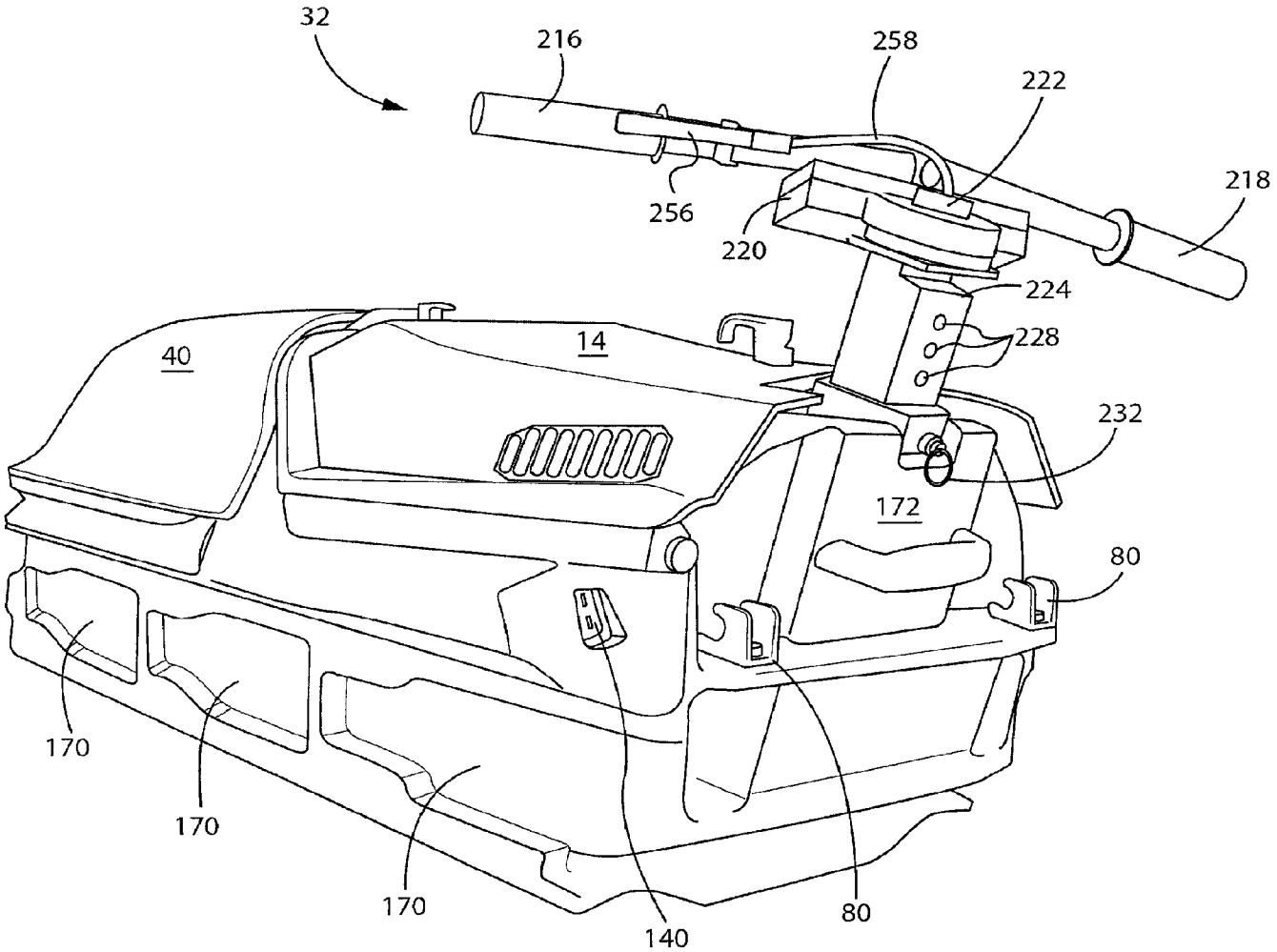
FIG. 22 is a more side oriented perspective view of the forward facing portion of the power pod shown in FIG. 21 and shows the steering mechanism associated with operation thereof.

Although generally shown as a projection and cavity interface, it is appreciated that other geometric interfaces and number of interfaces can be provided to effectuate the desired severable but secure connection of sponsons 16, 18, 20 with power pod 12. For instance, it is appreciated that the orientation of the projections and recesses could be reversed such that the recesses are formed in sponsons 18, 20 and the projections extend from power pod 12. It is further appreciated that the other geometrically shaped interfaces, such as a dovetail shaped connection methodology, as shown in FIG. 21A could be provided. It is appreciated that such constructions generally include triangular shaped projections 75 and recesses 77 that cooperate in a manner wherein the projections and recesses slidably cooperate with one another and a first direction 79, can limit the degree of translation in the first direction, and limit translation between the adjacent structures in directions that are not aligned with the desired translation direction. Preferably, regardless of the geometric interface, the adjoining surfaces include an engagement structure or projection that movably cooperates with a recess or interface of an adjacent structure to tolerate controlled translation between the adjacent structures.

Additionally, it is further envisioned that alternate sponsons may be attached to the power pod to provide different ride characteristics of the resultant personal watercraft. Different attachments would accommodate different riding positions and different bodies of water. For example, one sponson configuration could enable optimum enjoyment on relatively calm waters of a small lake, while a different sponson configuration could provide optimum enjoyment on the choppy ocean waters. The entire personal watercraft can be transformed into a multitude of different shapes and forms without having to replace the expensive power pod propulsion system. The modularity of the hull structure offers unprecedented flexibility in configuring a personal watercraft for various uses by merely swapping different sponsons.

Moreover, the individual components need not be formed in the disclosed shapes, or assembled in the disclosed configuration, but could be provided in virtually any shape, and assembled in virtually any configuration. Furthermore, all the disclosed features can be combined with, or substituted for, the disclosed features of every other disclosed embodiment except where such features are mutually exclusive. For instance, it is envisioned that sponsons 18, 20 could be provided with a standoff or other such structure such that one or both of sponsons 18, 20 be positioned laterally outboard relative to the lateral sides of power pod 12. It is envisioned that such a configuration would tolerate riders at locations generally above the sponsons in either a fully supported configuration or a configuration wherein the rider and the operator can be exposed to a water flow adjacent one or more of the lateral sides of power pod 12. Such a modification is but one envisioned exemplary alteration to the configuration of watercraft 10 shown in the drawings.

Regardless of the resultant shape of the underlying watercraft, it is appreciated that one or more of hull or sponson portions 12, 16, 18, 20 can be formed by various of different methods including fiberglass molding, injection molding, blow molding, compression molding, rotomolding, or other suitable molding processes of other manufacturing processes. It is further appreciated that one or more of respective hull portions could include reinforcing materials such as carbon fiber, Kevlar, glass fiber, or the like may be also to improve aspects such as the longevity and/or strength, rigidity, flexibility, ultraviolet (UV) resistance, etc., of watercraft 10 and power pod 12.

Referring to FIGS. 19-25, steering assembly 32 of power pod 12 includes a starboard grip 216 and a port grip 218 that are attached to a steering stem plate 220. As explained further below, grips 216, 218 are preferably movably attached to plate 220 to tolerate various operating positions of grips 216, 218 associated with a user's preferences and/or movable between an in-use and a stowed orientation to improve the compact nature of power pod 12 during non-use thereof. Stem plate 220 is secured to a steering stem 222 whose rotation manipulates the orientation of discharge nozzle 48 (FIG. 20) relative to hull 172 of power pod 12 and thereby effectuates the direction of travel of watercraft 10. Steering stem 222 is rotationally supported by a steering column 224 that slidably cooperates with a collar 226 affixed a hull 172 of power pod 12. It is appreciated that the steering functionality of watercraft 10 could alternatively be provided to include an electronic interface associated with communication manipulations of the steering assembly to effectuate manipulation of the nozzle assembly.

Figure 24:
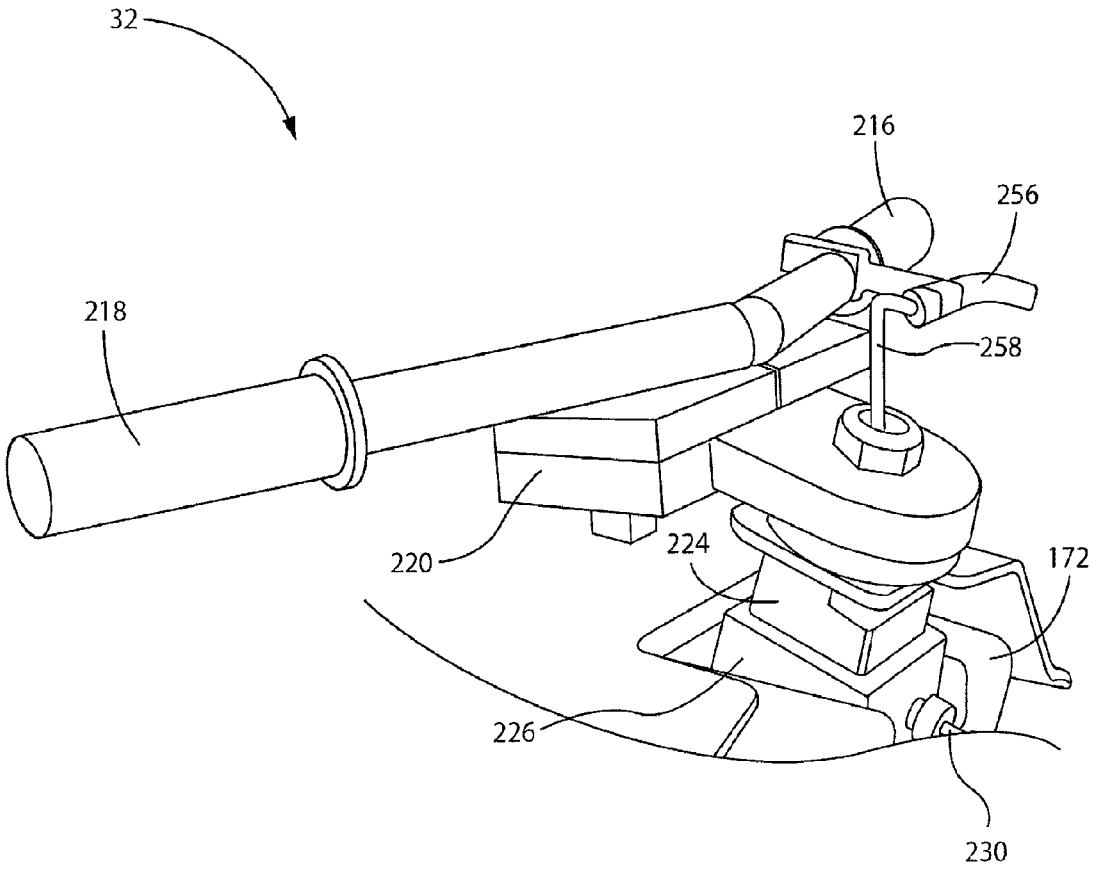
FIG. 24 is a view similar to FIG. 23 and shows the steering mechanism in a second vertical orientation.

Column 224 includes one or more holes or recesses 228 that are shaped and positioned to cooperate with a catch 230 supported by collar 226. Catch 230 is preferably biased in the direction toward engagement with a respective recess 228 associated with column 224. A pull ring 232 is attached to catch 230 and allows a user to manipulate catch 230 out of engagement with a respective recess 228 such that column 224 can slidably cooperate with collar 226 so as to manipulate the elevation of grips 216, 218 of steering assembly 32 relative to power pod 12. Referring to FIGS. 21 and 24, steering assembly 32 is vertically movable between a fully raised orientation, as shown in FIG. 21, and a lowered orientation, as shown in FIG. 24, and is preferably securable at various positions therebetween associated with the cooperation of catch 230 with a respective recess 228 of column 224. Such a construction allows steering assembly 32 to attain various vertical orientations as may be desired to satisfy different user preferences. Such a construction also facilitates a compact configuration of the steering assembly 32 relative to power pod 12 for storage and transport operations. It is further appreciated that steering assembly 32 may be provided in a removable configuration if the operational instructions associated with communicating steering, throttle, and power plant operation instructions between the user input and the power plant and communicated electrically therebetween.

Figure 23:
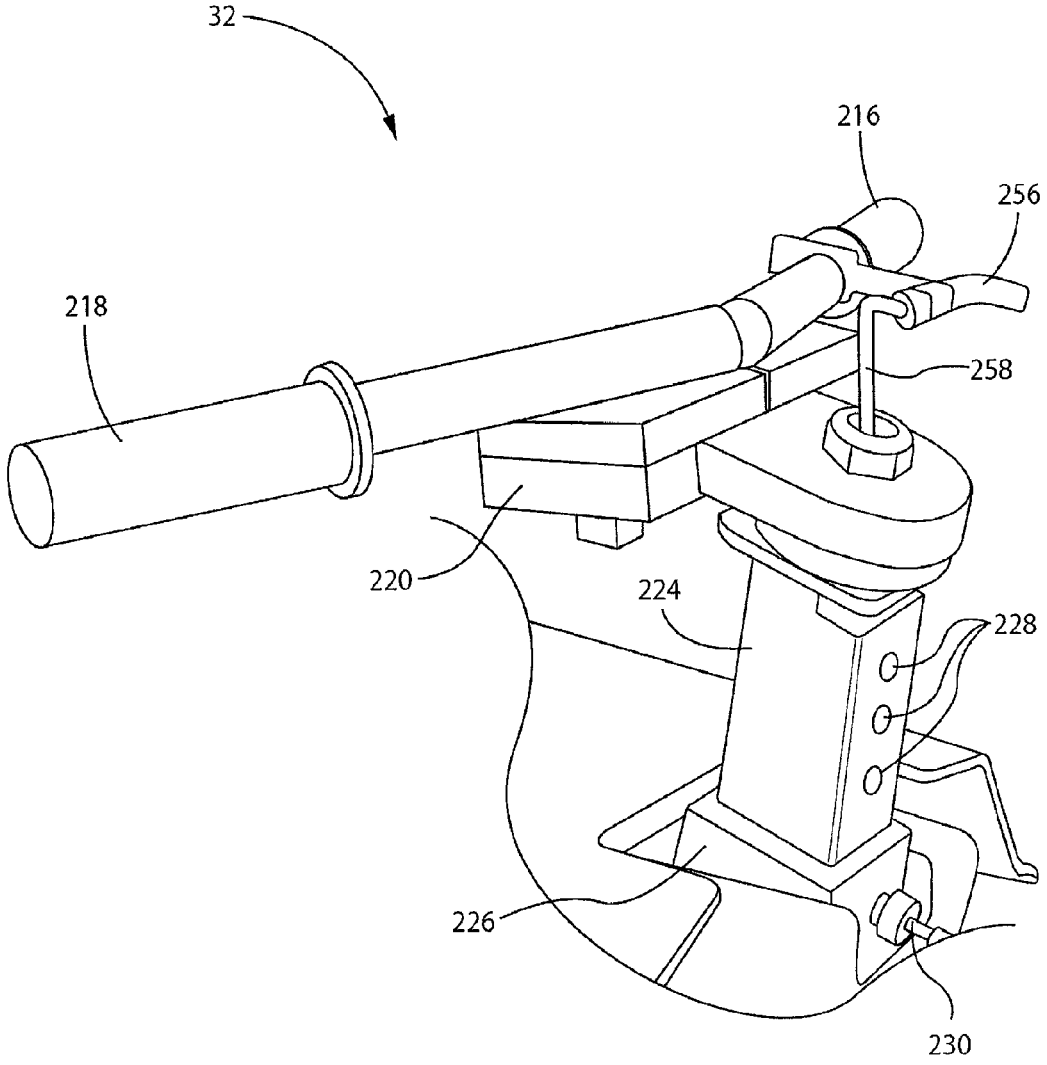
FIG. 23 is a front perspective view of an alternate side of the steering mechanism shown in FIG. 22 with the steering mechanism in a first vertical orientation.
Figure 25:
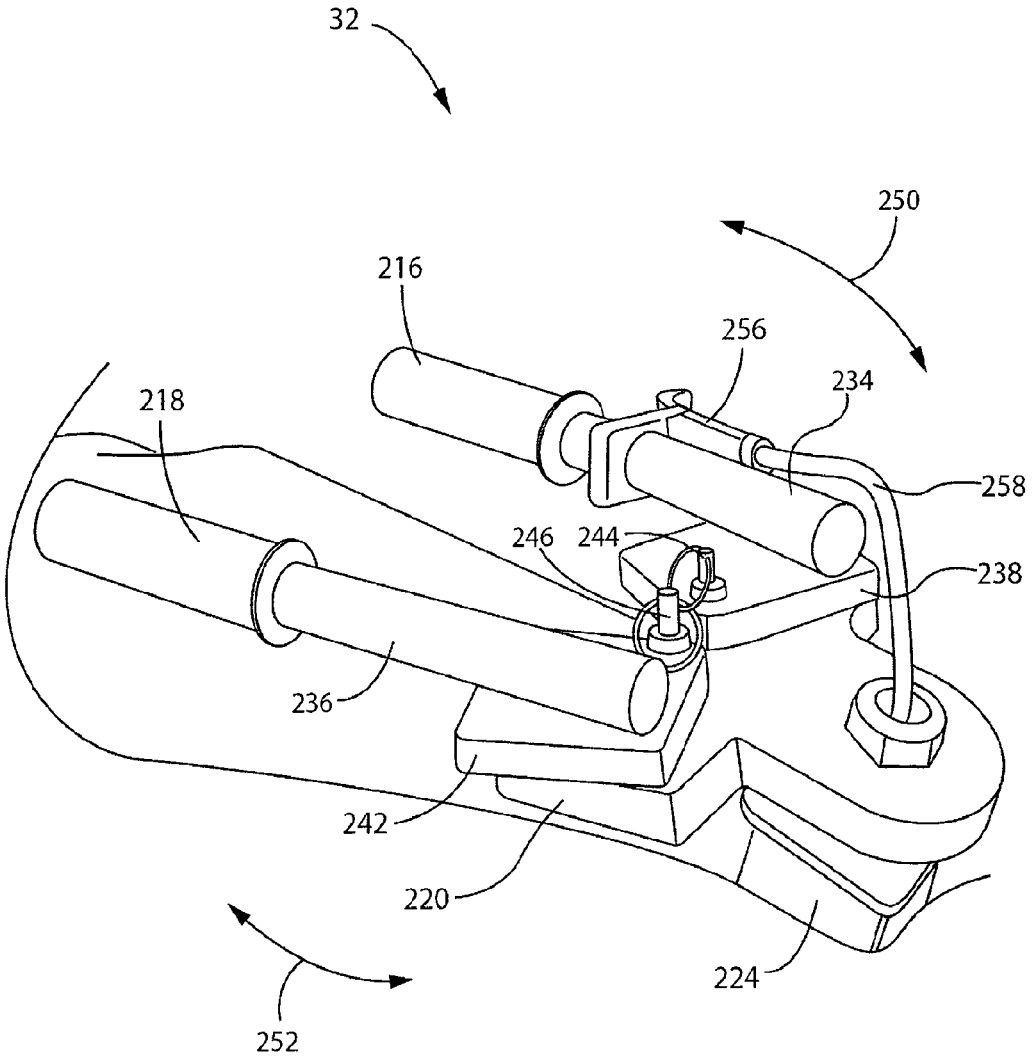
FIG. 25 is a front side top perspective view of the steering mechanism and shows a pair of handle grips folded toward a more compact orientation.

In addition to the vertical adjustability of steering assembly 32 as described above, steering assembly 32 is also constructed to manipulate the lateral footprint associated with the orientation of grips 216, 218 relative to plate 220. As shown in FIGS. 23 and 24, grips 216, 218 are positionable relative to plate 220 so as to extend in a generally lateral direction relative to the longitudinal axis of watercraft 10. Referring to FIG. 25, each grip 216, 218 is associated with a shaft 234, 236 that is attached to a corresponding base 238, 242 that is pivotably connected to plate 220 of steering assembly 32. Each base 238, 242 includes a catch 244, 246 that is operable in a manner similar to catch 230 to allow rotation of the respective shafts 234, 236 in generally inward and outward radial directions, indicated by arrows 250, 252, relative to plate 220. Such a construction reduces the lateral footprint associated with power pod 12 when grips 216, 218 are positioned in an inward most or stowed orientation, as is shown in FIG. 25, relative to widest available in-use orientation of grips 216, 218, as shown in FIG. 24.

Referring to FIGS. 24-25, steering assembly 32 includes a throttle grip 256 that is positionally associated relative to one of grips 216, 218 of steering assembly 32. Grip 256 is operationally connected via a cable 258 to the power plant associated with power pod 12. Like steering input signals, it is appreciated that the throttle input signal between the user interface and the power plant could also be provided in an electronic operating modality. When provided in an engine powered configuration, cable 258 can be referred to as a throttle cable. When provided in a motor based configuration, cable 258 is constructed to manipulate the operational speed of the motor and thereby the pump which in turn effectuates the operational speed of the resultant watercraft 10.

Figure 26:
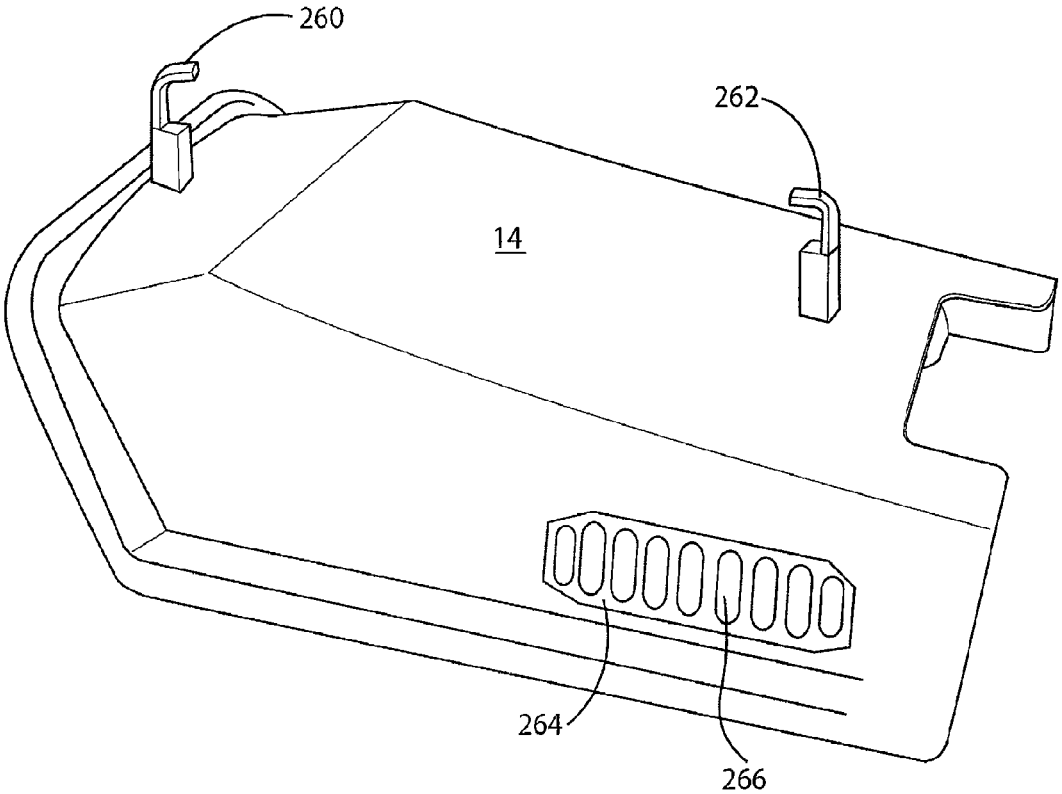
FIG. 26 shows a cover removed from the power pod shown in FIG. 19.

FIG. 26 shows cover 14 removed from the hull 172 of power pod 12. Cover 14 includes a first latch assembly 260 and the second latch assembly 262 to cooperate with an opening of hull 172 of power pod 12 and generally overlie the power plant and propulsion system contained within power pod 12. Cover 14 includes an intake 264 constructed to allow air for a combustion process to enter power pod 12. Preferably, a gasket 266 underlies intake 264 and prevents the ingress of water into the compartment enclosed by hull 172 and cover 14 of power pod 12.

Figure 27:
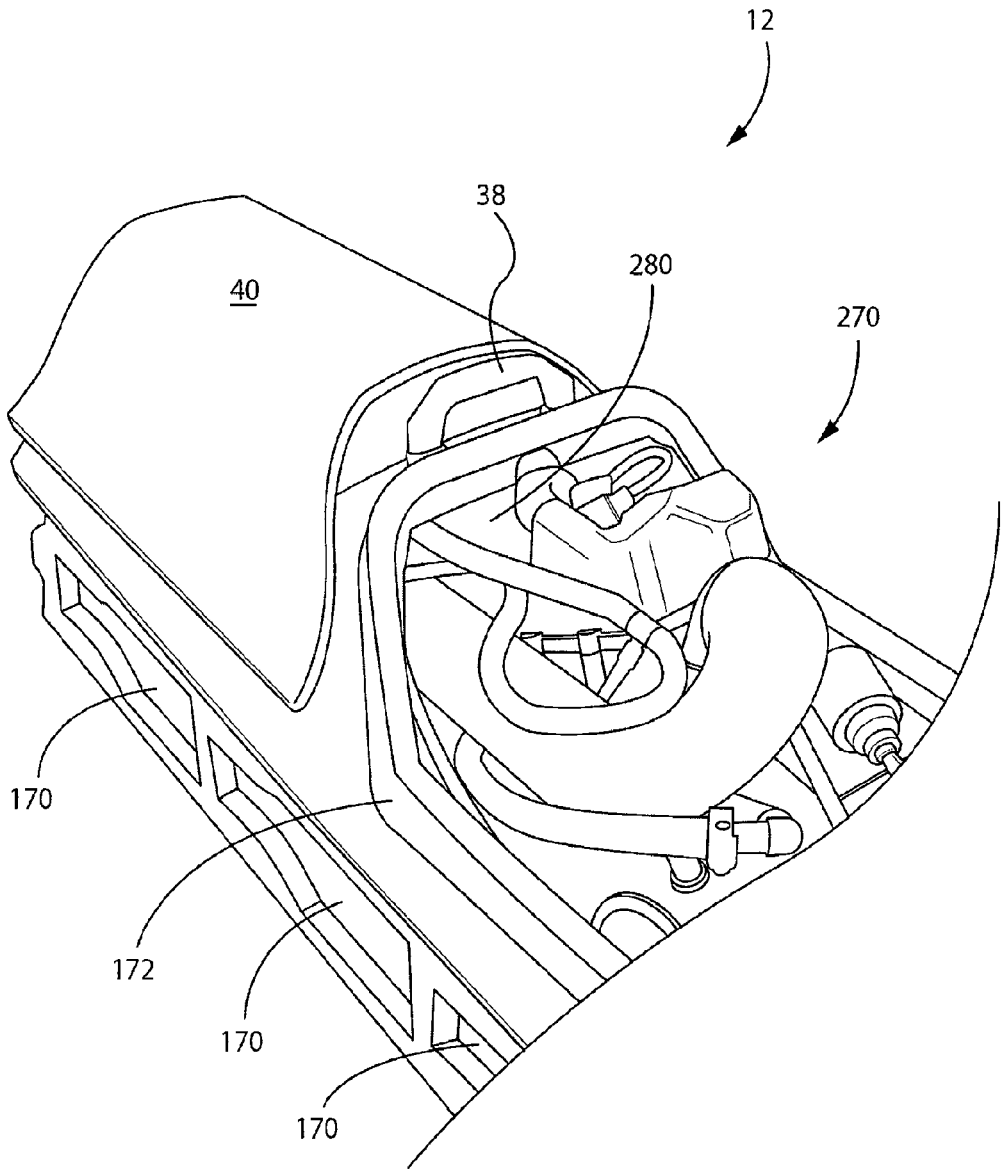
FIG. 27 is a top perspective view of the power pod shown in FIG. 19 with the cover shown in FIG. 26 removed therefrom so as to expose the power plant of the power pod.
Figure 28:
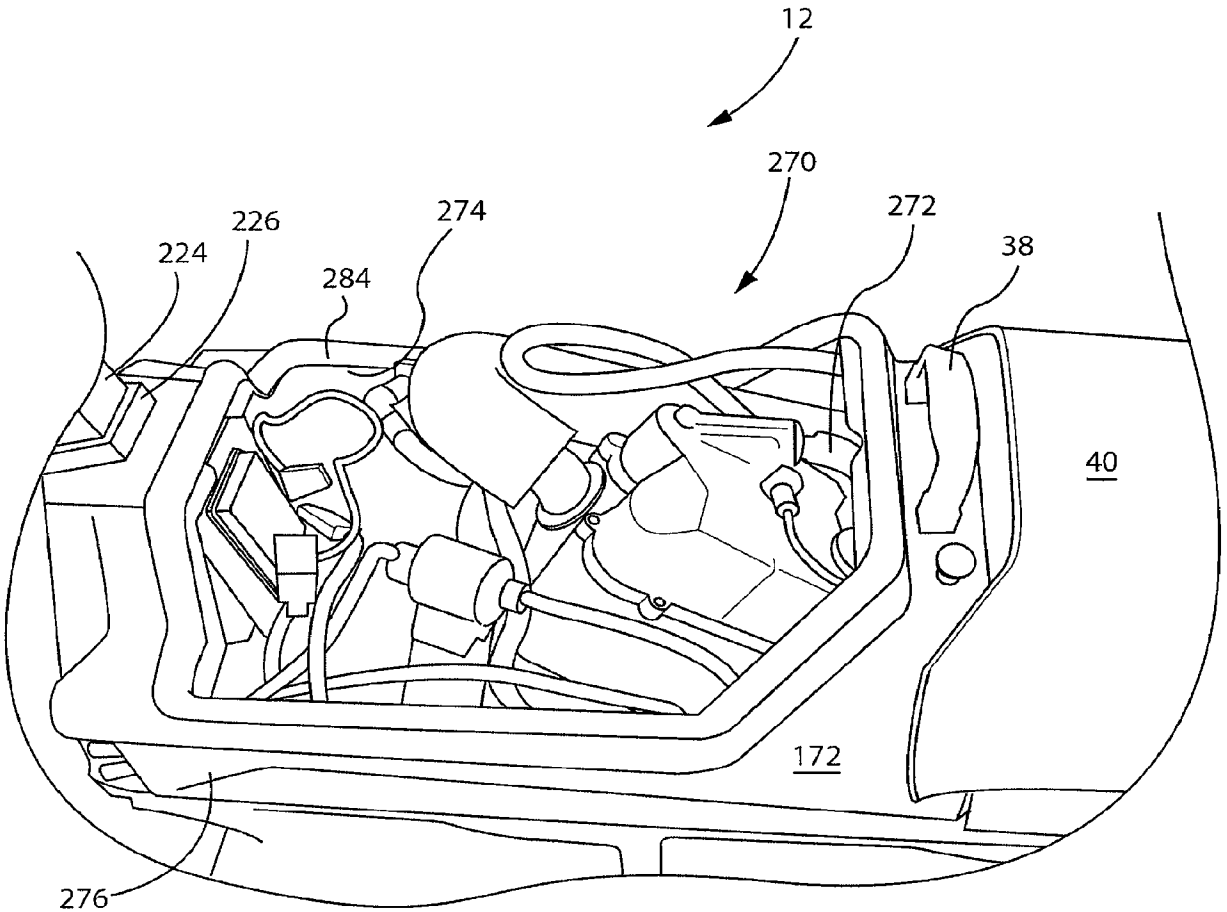
FIG. 28 is an alternate side top perspective view of the power pod shown in FIG. 27.

Referring to FIGS. 27 and 28, power pod 12 includes a power plant 270, such as an engine or internal combustion engine or motor, contained within a cavity 272 defined by hull 172 of power pod 12. Hull 172 includes an interior surface 274 that generally faces power plant 270 and exterior surface 276 that faces the environment therearound. Power plant 270 is operationally connected to a propulsion system or pump 280 whose operation is associated with propulsion of watercraft 10. Preferably, interior surface 274 of hull 172 of power pod 12 includes one or more of an engine silencer passage and/or a pump housing that can be integrally formed with the hull and shaped to cooperate with the respective power plant 270 and/or pump 280. A gasket or seal 284 is preferably disposed about a perimeter of the opening associated with cooperation of cover 14 with hull 172 of power pod 12 such that the seal 280 cooperates with an underside of cover 14 to provide a sealed interaction therewith. Handle 38 is generally disposed between cover 14 and support surface 40 of power pod 12 so as to be gripped by a user to facilitate manual transportation of power pod 12.

The separable nature of the various hull and hull portions, as well as the segregation of the various components and systems associated with operation of the power pod, provides a watercraft that is individually transportable without the need of supplemental trailers and/or equipment. The various connection interfaces between power pod 12 and supplemental hull or sponson portions 16, 18, 20 allows power pod 12 to cooperate with other sponson shapes and even other watercraft for utilization of the power pod with various watercraft and for the generation of differently configured resultant watercraft. It is further envisioned that users may have sponsons having different sizes and shapes suitable for different purposes and/or operating conditions so as to allow the utilization of the power pod with various such configurations. That is, a user could have different types of sponsons to accommodate different rider sizes, different numbers of riders, weight, riding position, and bodies of water (e.g., ocean, pond, big lake, etc.). Users or even third parties could even create their own sponson designs thereby even further improving the functionality of the underlying device.

It is intended that the appended claims cover all such additions, modifications, and rearrangements. Expedient embodiments of the present invention are differentiated by the appended claims which also form part of the specification.

What is claimed is:

1. A modular personal watercraft comprising:

a power pod encapsulating a power plant and a steering mechanism of the personal watercraft, the power pod including at least one interface that is defined by at least one projection and at least one recess;

a cover that removably cooperates with the power pod to allow access to an engine compartment defined by the power pod, the cover being configured to cooperate with the power pod so that the power pod is generally enclosed;

at least one sponson that removably cooperates with a forward facing end of the power pod, the at least one sponson being buoyant and including an engagement structure that is defined by at least one projection and at least one recess such that the engagement structure of the at least one sponson and the at least one interface of the power pod are translatable relative to one another in a longitudinal direction to index a position of the at least one sponson relative to the power pod and generate a physical interference between the at least one sponson and the power pod; and at least one supplemental system component necessary for operation of the power plant disposed in the at least one sponson and severably connectable to the power plant when the power pod and the at least one sponson are connected to one another.

2. The modular personal watercraft of claim 1 wherein the at least one supplemental system component disposed in the at least one sponson is further defined as at least one of a fuel source, an oil source, and a battery associated with operation of the power plant.

3. The modular personal watercraft of claim 2 further comprising a tool-less and selectively severable connection between the at least one of the fuel source, the oil source, and the battery and the power pod.

4. The modular personal watercraft of claim 1 further comprising a second sponson that is positioned one of port or starboard of the power pod and is constructed to removably cooperate therewith.

5. The modular personal watercraft of claim 4 further comprising a third sponson that is positioned the other of port or starboard of the power pod such that the power pod is disposed between the at least one sponson, the second sponson, and the third sponson.

6. The modular personal watercraft of claim 5 wherein the at least one sponson cooperates with the power pod and the second sponson and the third sponson to selectively secure each of the at least one sponson, the second sponson, and the third sponson to the power pod when the at least one sponson is engaged therewith.

7. The modular personal watercraft of claim 1 wherein at least one of the at least one interface and the engagement structure further comprises a reinforcement that cooperates with the other of the at least one interface and the engagement structure.

8. The modular personal watercraft of claim 1 wherein the power plant encapsulated by the power pod is further defined as one of a motor that is powered by a battery disposed in the at least one sponson and an internal combustion engine powered by a combustible fuel disposed in the at least one sponson.

9. The modular personal watercraft of claim 1 further comprising at least one of an engine exhaust silencer and a pump housing formed integrally with the power pod.

10. A power pod for a personal watercraft comprising:

a hull that defines an interior facing surface and an exterior facing surface;

a power plant disposed in a volume generally surrounded by the hull such that the interior facing surface of the hull faces the power plant;

at least one selectively severable connection operatively connected to the power plant and associated with the exterior facing surface of the hull the at least one selectively severable connection configured to operatively connect an auxiliary system that is external to the hull and necessary for operation of the power plant to the power plant; and an interface defined by at least a portion of the exterior facing surface of the hull, the interface constructed to removably cooperate with a hull portion such that the hull and hull portion cooperate to define a shape associated with a longitudinal axis of a watercraft hull and wherein the interface is oriented to extend in a lateral direction that extends between a port side and a starboard side across the longitudinal axis of the watercraft hull.

11. The power pod of claim 10 wherein at least one of the hull and the hull portion cooperate with at least one sponson in a slidable manner wherein the at least one of the hull and hull portion and at least one sponson are movable between a first orientation wherein the at least one of the hull and the hull portion cooperates with the at least one sponson in a first direction and a second orientation that achieves an interlock between the at least one of the hull and the hull portion and the at least one sponson wherein the interlock prevents translation between the at least one of the hull and the hull portion and the at least one sponson along the first direction.

12. The power pod of claim 10 wherein the power plant is further defined as one of a motor or an internal combustion engine.

13. The power pod of claim 10 wherein the auxiliary system that is external to the hull is further defined as at least one of a fuel source, an oil source, and a battery.

14. The power pod of claim 13 wherein the at least one selectively severable connection is further defined as a tool-less selectively severable connection that is operable from a location external to the hull, the tool-less selectively severable connection being provided between the power plant and the at least one of the fuel source, the oil source, and the battery.

15. The power pod of claim 10 wherein the watercraft hull is further defined as one of a personal watercraft, a boat, a rigid inflatable boat, a canoe, a kayak, or a catamaran.

16. The power pod of claim 10 further comprising a tool-lessly operable connector that secures the hull and the hull portion to one another.

17. The power pod of claim 16 further comprising at least one sponson that is selectively securable to at least one of the hull and the hull portion and cooperates with the hull and hull portion so that operation of the tool-lessly operable connector secures the hull, hull portion, and at least one sponson relative to one another when the connector is closed.

18. The power pod of claim 17 further comprising at least one wheel that removably cooperates with at least one of the hull, the hull portion, and the at least one sponson.

19. The power pod of claim 10 wherein the interface is further defined by at least one of a dove-tail connection and a slidable keyed interface.

20. A method of forming a watercraft power pod comprising:

forming a first hull portion to contain a power plant;

forming a second hull portion that removably cooperates with a forward facing end of the first hull portion and is configured to contain at least one of a consumable or replenishable resource associated with operation of the power plant; and shaping the first hull portion and the second hull portion to form a mechanical interface that limits motion between the first hull portion and the second hull portion in at least two directions when the first hull portion and the second hull portion are positionally associated with one another; and providing a tool-lessly severable connection that is external to the first hull portion and the second hull portion between the power plant contained in the first hull portion and the at least one of the consumable and replenishable resource contained in the second hull portion.

21. The method of claim 20 further comprising providing a third hull portion that forms another mechanical interface between the third hull portion and the first hull portion.

22. The method of claim 21 further comprising shaping the first hull portion and the third hull portion to form another mechanical interface therebetween.

23. The method of claim 22 further comprising providing a fourth hull portion that forms a third mechanical interface between the fourth hull portion and at least one of the first, second, and third hull portions.

24. The method of claim 23 further comprising providing at least one tool-lessly operable latch mechanism secured to one of the first, second, third and fourth hull portions and removably engageable with at least one of the other of the first, second, third, and fourth hull portions.

25. The method of claim 24 further comprising maintaining an isolation of at least one of the first, second, third, and fourth hull portions from direct interaction with the tool-lessly operable latch mechanism.

26. The method of claim 20 further comprising disposing at least one of a fuel tank, an oil tank, and a battery in the second hull portion.

27. The method of claim 26 further comprising providing a dedicated tool-lessly severable connection between each of the at least one of a fuel tank, an oil tank, and a battery associated with the second hull portion and the power plant contained in the first hull portion.

28. The method of claim 20 further comprising forming at least one of an exhaust passage and a pump housing integrally with the first hull portion such that the exhaust passage and the pump housing are exposed to a volume shaped to receive the power plant.

29. The method of claim 20 further comprising connecting a collapsible steering assembly to at least one of the first hull portion and the second hull portion and configuring the collapsible steering assembly to be adjustable in at least two of a telescopic manner, a vertical direction, and a radial direction relative to an axis of rotation of the collapsible steering assembly.

* * * * *